US007503302B2

(12) United States Patent
Miyashita et al.

(10) Patent No.: US 7,503,302 B2
(45) Date of Patent: Mar. 17, 2009

(54) INTAKE DEVICE FOR OUTBOARD MOTORS

(75) Inventors: Yasushi Miyashita, Hamamatsu (JP); Hiromichi Takewaki, Hamamatsu (JP); Jun Itoh, Hamamatsu (JP); Hideo Koyama, Hamamatsu (JP)

(73) Assignee: Suzuki Motor Corporation, Hamamatsu-shi (JP)

( * ) Notice: Subject to any disclaimer, the term of this patent is extended or adjusted under 35 U.S.C. 154(b) by 0 days.

(21) Appl. No.: 11/787,539

(22) Filed: Apr. 17, 2007

(65) Prior Publication Data

US 2007/0240681 A1 Oct. 18, 2007

(30) Foreign Application Priority Data

Apr. 18, 2006 (JP) ..... 2006-114883
Apr. 28, 2006 (JP) ..... 2006-125690

(51) Int. Cl.
*F02M 35/10* (2006.01)

(52) U.S. Cl. ..... 123/184.34; 440/88 A

(58) Field of Classification Search .....
123/184.31–184.34, 184.37, 195 P, 195 HC, 123/196 W; 440/88 A
See application file for complete search history.

(56) References Cited

FOREIGN PATENT DOCUMENTS

| | | | |
|---|---|---|---|
| JP | 09-042088 | A | 2/1997 |
| JP | 2001-336425 | A | 12/2001 |
| JP | 2002-242682 | A | 8/2002 |
| JP | 2002-242777 | A | 8/2002 |
| JP | 2004-232591 | A | 8/2004 |
| JP | 2004-270563 | A | 9/2004 |

*Primary Examiner*—Noah Kamen
(74) *Attorney, Agent, or Firm*—Frishauf, Holtz, Goodman & Chick, P.C.

(57) ABSTRACT

An intake device for outboard motors, which makes it possible to improve intake performance and reduce the size of the device at the same time. Cylinder banks have a plurality of cylinder bores arranged in a vertical direction, and extend rearward to form a V shape. Intake ports of the respective cylinder bores are formed in the cylinder banks to open in the inner sides of the V shape. An intake manifold is connected to the intake ports. A surge tank is connected to the intake manifold. A throttle body is connected to the surge tank. The surge tank comprises a plurality of intake passage members connected to the respective cylinder bores via the intake manifold, wall members provided between respective adjacent ones of the intake passage members, and a lid member configured to hermetically close a space defined by the intake passage members and the wall members.

7 Claims, 18 Drawing Sheets

INTAKE DEVICE FOR OUTBOARD MOTORS

BACKGROUND OF THE INVENTION

1. Field of the Invention

The present invention relates to an intake device for outboard motors, and more particularly to an intake device for outboard motors equipped with a V-type engine for vertical installation.

2. Description of the Related Art

Conventionally, a general type of intake device for outboard motors equipped with a V-type engine has surge tanks provided for respective cylinder banks (see e.g. Japanese Laid-Open Patent Publications (Kokai) No. H09-42088 and No. 2002-242777). However, the conventional intake device, which is provided with two surge tanks, needs a complicated construction, which inevitably increases the size of the device. Further, it is required to form a bend in an intermediate portion of an intake passage member connecting between each surge tank and an associated cylinder head, and the bend causes intake air resistance, which leads to degradation of the intake performance of the outboard motor.

On the other hand, conventionally, there has also been an intake device for outboard motors equipped with a V-type engine, which is provided with a single surge tank (see e.g. Japanese Laid-Open Patent Publication (Kokai) No. 2004-232591). This intake device has funnel-shaped members provided in the surge tank, as inlet ports each connected to an intake passage member. The funnel-shaped members are arranged in a manner isolated from each other so as to avoid interference between adjacent ones thereof, whereby the improvement of intake efficiency is achieved.

However, an intake device for outboard motors, provided with the throttle valve disclosed in Japanese Laid-Open Patent Publication (Kokai) No. 2004-232591 suffers from a problem that it is difficult to secure a sufficient capacity of a surge tank due to the construction of an outboard motor, and hence, when a sufficient capacity of a surge tank cannot be secured, it is impossible to provide the funnel-shaped members.

Further, conventionally, another intake device for outboard motors equipped with a V-type engine has been disclosed in which a single mechanical throttle body is provided in a central part of a V-bank (see e.g. Japanese Laid-Open Patent Publications (Kokai) No. 2001-336425 and No. 2002-242682). The mechanical throttle body requires provision of a lever and a linkage for opening and closing a throttle valve, and hence it is required to dispose the mechanical throttle body such that the lever and the linkage do not cause interference with components parts therearound. For this reason, in the conventional intake device of an outboard motor equipped with a V-type engine, the throttle body is disposed above the surge tank and the manifold of the engine at a location slightly away therefrom, with intake passage members thereof oriented in the longitudinal direction of the outboard motor, which causes an increase in the vertical dimension of the conventional intake device.

Insofar as a throttle valve is concerned, there has conventionally been disclosed an electronically-controlled throttle body (see e.g. Japanese Laid-Open Patent Publication (Kokai) No. 2004-270563). The electronically-controlled throttle body can have a smaller size than the mechanical throttle body.

In the above-described conventional intake devices for outboard motors equipped with a V-type engine, it is easy to simply replace the mechanical throttle body with the electronically-controlled throttle body. However, the problem concerning the size of the intake device cannot be solved by simply changing the mechanical throttle body to the electronically-controlled throttle body.

In addition, the conventional intake devices have a silencer mounted to the end of an intake port of the throttle body in a protruding manner, which causes further increase in the size of the intake device.

As described above, the conventional intake devices for outboard motors cannot avoid increase in device size or degradation of intake performance.

SUMMARY OF THE INVENTION

The present invention provides an intake device for outboard motors, which makes it possible to improve intake performance and reduce the size of the device at the same time.

In a first aspect of the present invention, there is provided an intake device for an outboard motor, comprising intake ports of a plurality of respective cylinder bores formed in cylinder banks which extend rearward in a manner opening to form a V shape and have the cylinder bores vertically arranged, the intake ports being configured to open in inner sides of the V shape, an intake manifold configured to be connected to the intake ports, a surge tank connected to the intake manifold, and a throttle device connected to the surge tank, wherein the surge tank comprises a plurality of intake passage members connected to the respective cylinder bores via the intake manifold, wall members provided between respective adjacent ones of the intake passage members, and a lid member hermetically closing a space defined by the intake passage members and the wall members.

With the arrangement of the first aspect of the present invention, the surge tank is formed by the intake passage members connected to the respective cylinder bores via the intake manifold, the wall members provided between respective adjacent ones of the intake passage members, and the lid member hermetically closing the space defined by the intake passage members and the wall members. Therefore, the surge tank can be reduced in size, which makes it possible to reduce the size of the device. This makes it possible to reduce the size of the intake device, thereby making the outline or contour of the engine compact in size. In addition, since a sufficient capacity of the surge tank can be secured even in a small space, it is possible to reduce the size of the intake device and improve intake performance at the same time, thereby enhancing the output of the outboard motor.

Each of the intake passage members can be configured to be formed coaxial with an associated one of the intake ports.

With this configuration, it is possible to make the intake passage members longer and reduce intake air resistance, to thereby enhance intake efficiency.

The throttle device can be mounted on a vertically uppermost one of the wall members.

With this configuration, it is possible to further reduce the size of the device.

The intake device can include intake system parts arranged in a space enclosed by the cylinder banks, the surge tank, and an engine cover.

With this configuration, the size of the device can be further reduced. Further, e.g. when an air intake duct as an intake system part is disposed as described above, it is possible to extend the air intake duct up to the lower part of the engine, thereby enhancing the water-separating effect of the air intake duct. This contributes to enhancement of the output of the outboard motor.

The throttle valve can comprise an electronically-controlled throttle valve.

With this configuration, it is possible to further reduce the height of the throttle valve.

The throttle body is disposed at such a location that an upper end face thereof does not protrude higher than a rotary member mounted on an upper end of a crankshaft of the outboard motor.

With this configuration, it is possible to reduce the size of the intake device, thereby reducing the size of the outboard motor.

The throttle device includes an intake passage member extending in the vertical direction.

With this configuration, it is possible to further reduce the height of the throttle device, thereby achieving further reduction of the size of the intake device.

The intake device can further comprise a silencer covering around the electronically-controlled throttle device.

With this configuration, the vertical protrusion of the silence can be further reduced than in a conventional intake device having a silencer mounted on the opening end of a throttle device. This makes it possible to reduce the size of the intake device. In addition, it is possible to increase the capacity of the silencer and improve the performance of the outboard motor. Furthermore, since the silencer covers around the whole of the electronically-controlled throttle body which low in water resistance from above, it is possible to protect the electronically-controlled throttle body from water, thereby enhancing the durability of the intake device.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing preferred embodiments thereof.

Figure 1:
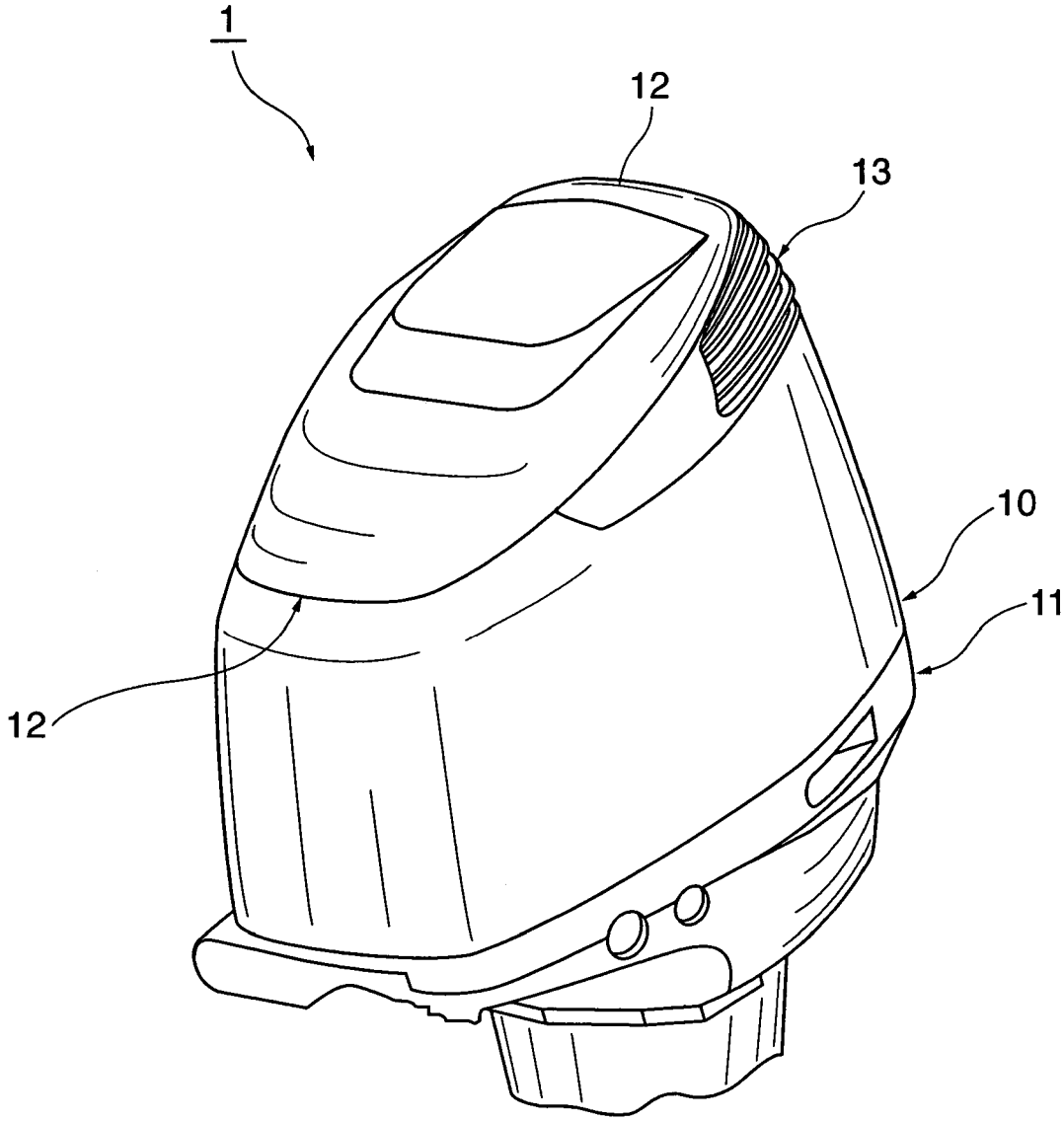
FIG. 1 is a perspective view of an upper half of an outboard motor equipped with an intake device according to an embodiment of the present invention.
Figure 2:
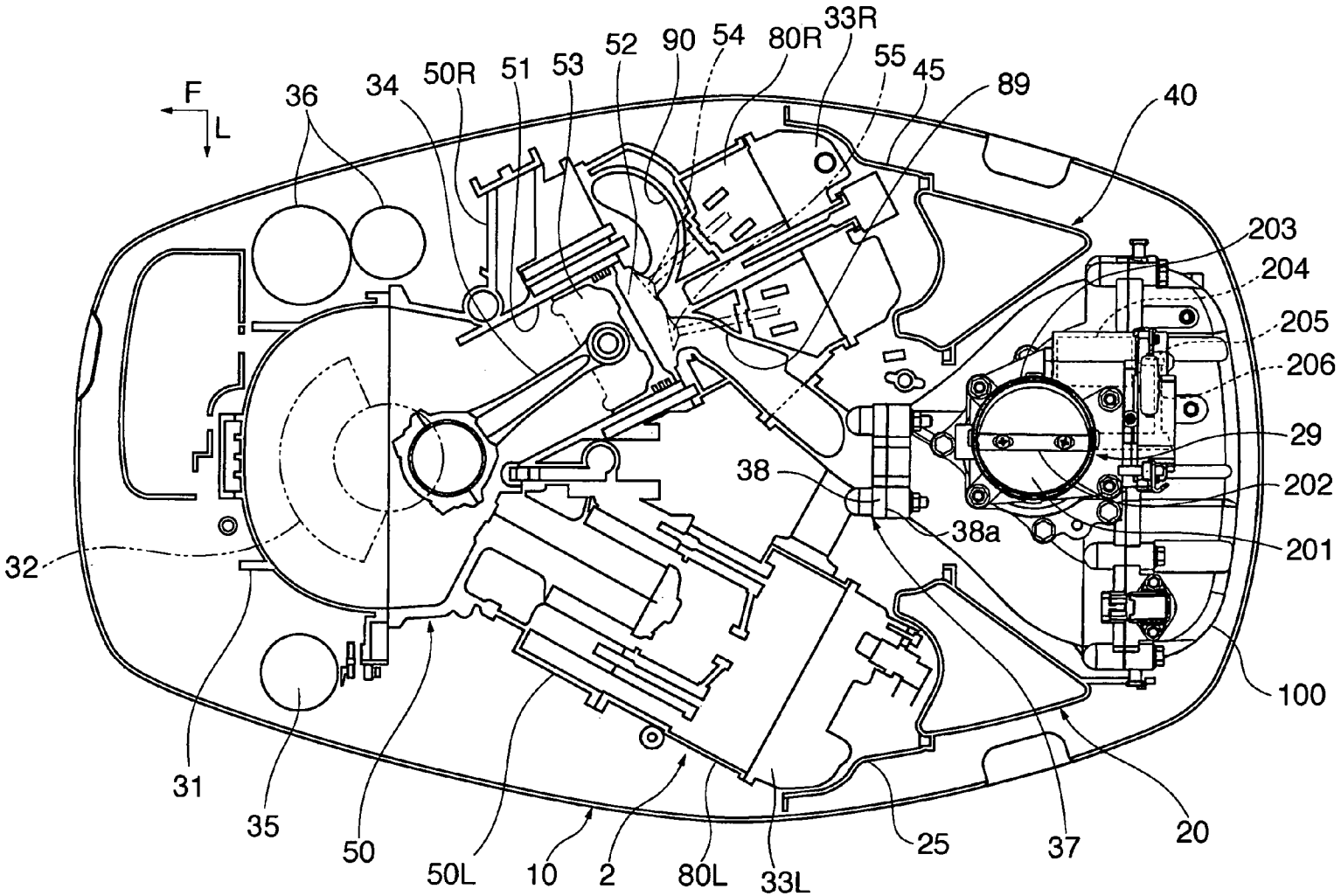
FIG. 2 is a partial horizontal cross-sectional view of the outboard motor in FIG. 1.

FIG. 1 is a perspective view of an upper half of an outboard motor 1 equipped with an intake device according to an embodiment of the present invention. FIG. 2 is a partial cross-sectional view of the outboard motor 1 as viewed in the horizontal direction. It should be noted that, as shown in FIG. 2, arrows F and L indicate a forward or bow direction and a port direction, as viewed on the outboard motor 1, respectively.

The outboard motor 1 is equipped with an engine 2, described in detail hereinafter. The engine 2 is a water-cooled four-cycle six-cylinder V-type engine having a crankshaft 32 substantially perpendicularly (vertically) installed therein and a cylinder block 50 integrally formed with a pair of left and right cylinder banks disposed in a V-shaped arrangement in plan view to form a rearwardly open V-shaped cylinder bank (V-bank).

As shown in FIG. 1, an upper cover 10 and a lower cover 11 cover around the engine 2. A top cover (tilt-up handle) 12 is mounted on the top of the upper cover 10, and a louver 13 that functions as an outside air intake port is attached between a rear part of the upper cover 10 and a rear part of the top cover 12.

As shown in FIG. 2, a crankcase 31 is disposed in the foremost end (i.e. on the bow side) of the engine 2, and the cylinder block 50 is disposed rearward of the crankcase 31. The crankshaft 32 is journaled between joined surfaces of the crankcase 31 and the cylinder block 50. The crankshaft 32 has an upper end protruding upward from the engine 2, and the protruding part is provided with a flywheel 71 and a magnet device 72 for power generation (see FIGS. 14 and 15). Hereafter, a description will be mainly given of a starboard side (right) cylinder bank since a port side (left) cylinder bank and the starboard side cylinder bank are basically identical in construction.

Reference numerals 50L and 50R indicate the left cylinder bank and the right cylinder bank of the cylinder block 50, respectively. A pair of left and right cylinder heads 80 are provided for the respective left and right cylinder banks in association with the respective left and right cylinder banks 50L and 50R. Each of the left and right cylinder banks 50L and 50R is formed therein with three cylinder bores 51. On the other hand, each of the cylinder heads 80 is formed with a combustion chamber 52 disposed in matching relation to an associated one of the cylinder bores 51, and an intake port 89 and an exhaust port 90 communicating with the combustion chamber 52. The cylinder heads 80 have head covers 33 (33L and 33R) mounted thereon, and intake and exhaust camshafts, not shown, are rotatably journaled in a cam chamber defined between each pair of the cylinder head 80 and the head cover 33.

Each of the intake ports 89 has an inlet opening that opens in an inner surface of the V shape formed by the cylinder banks (the cylinder head 80), and a communicating portion communicating with the associated combustion chamber 52, which is opened and closed by an intake valve 55. On the other hand, each of the exhaust ports 90 has an outlet opening that opens in an outer surface of the V shape formed by the cylinder banks (i.e. an outer surface of the cylinder head 80), and a communicating portion communicating with the associated combustion chamber 52, which is opened and closed by an exhaust valve 54. The reciprocating motion of a piston 53 slidably inserted in each cylinder bore 51 is converted to rotating motion of the crankshaft 32 by a connecting rod 34.

Further, on the port side of the crankcase 31 is disposed a fuel filter 35, while on the starboard side of the crankcase 31 is disposed a starter motor 36.

Figure 12:
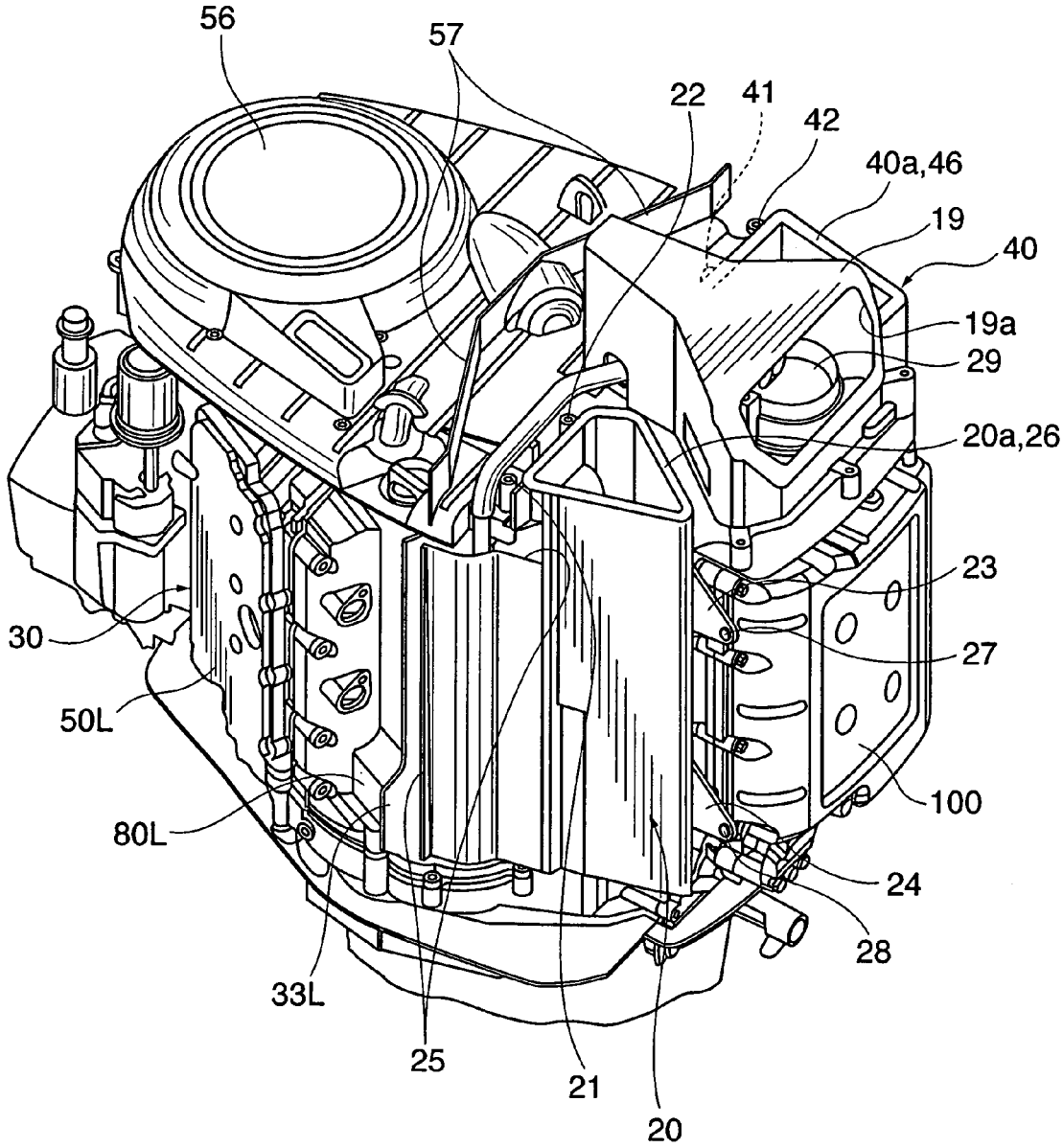
FIG. 12 is a perspective view of the appearance of the upper half of the outboard motor in FIG. 1 in a state where the engine cover assembly is removed therefrom.

As shown in FIG. 2, a surge tank 100 is disposed in the rear of the central part of the engine 2 such that it is connected with an intake manifold 37 connected to each of the intake ports 89. A throttle body 29 is connected to the surge tank 100. The throttle body 29 is accommodated in a silencer 19 disposed in the upper rear of the engine 2, as shown in FIG. 12. The throttle body 29 takes in outside air introduced into the silencer 19, through its opening, and the surge tank 100 takes in the outside air from the throttle body 29. The intake manifold 37, the surge tank 100, the throttle body 29, and the silencer 19 constitute an intake device of the outboard motor 1.

Next, a description will be given of the arrangement of the surge tank 100.

Figure 3:
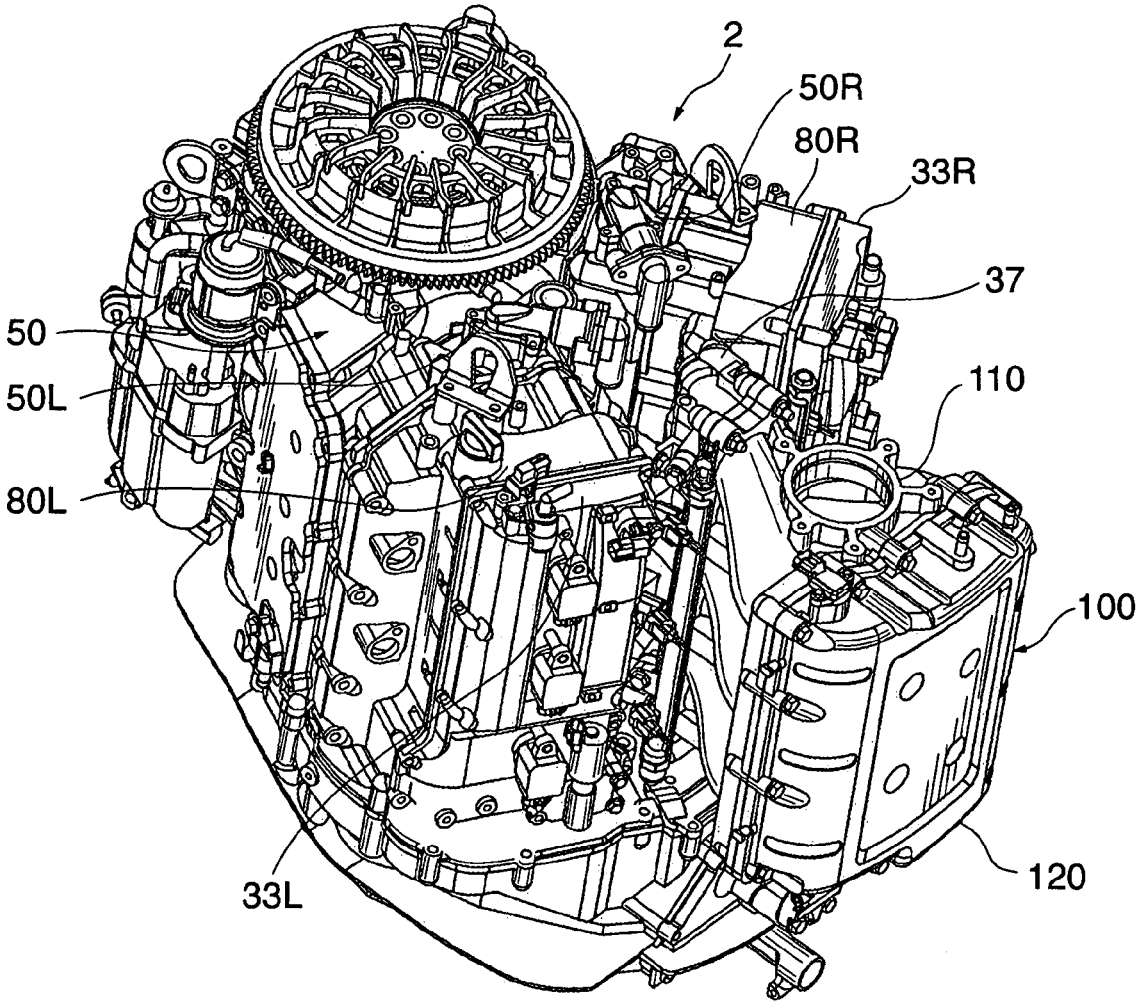
FIG. 3 is a left rear perspective view of an engine of the outboard motor in FIG. 1.
Figure 4:
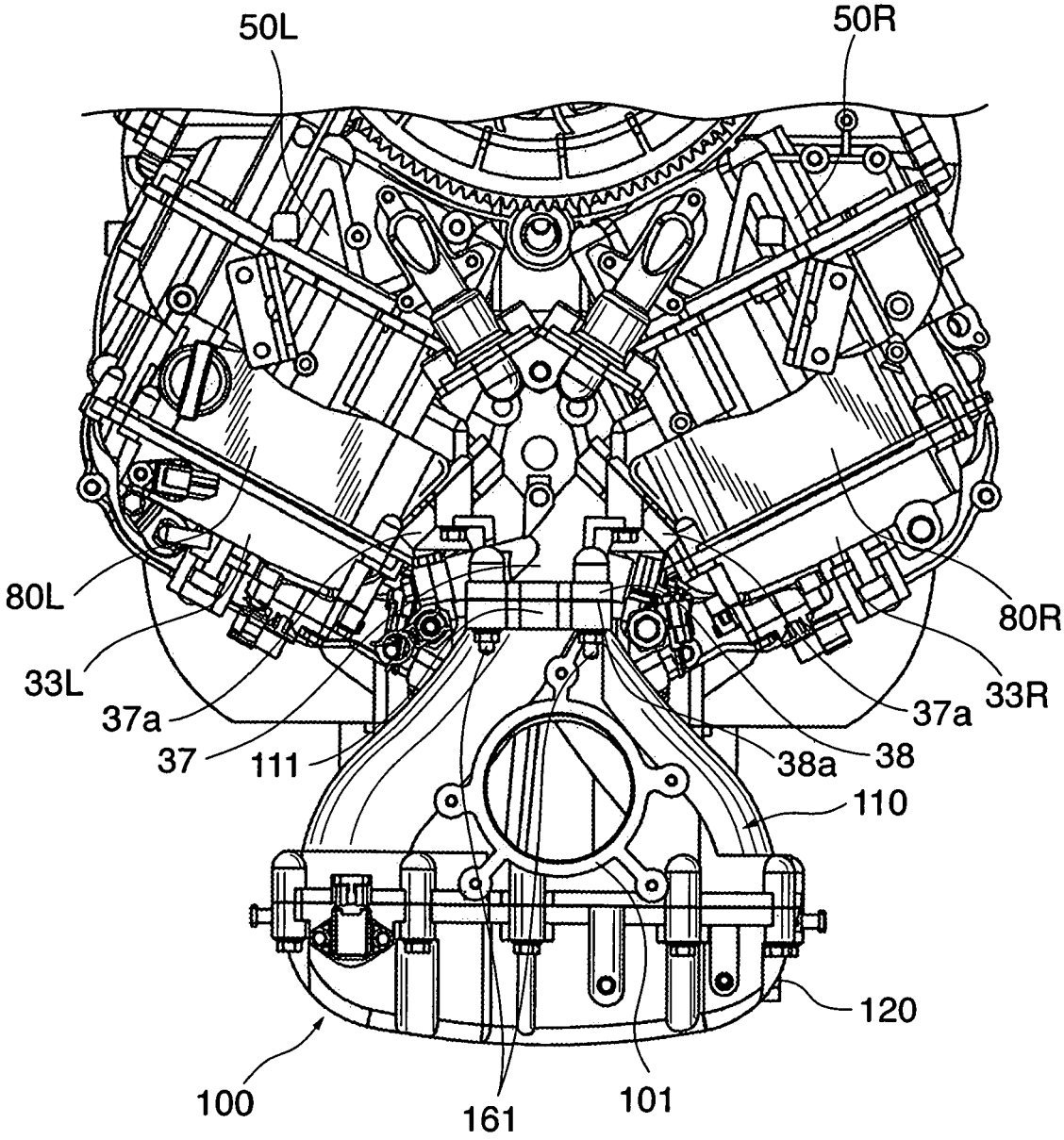
FIG. 4 is a top view of the engine of the outboard motor in FIG. 1.
Figure 5:
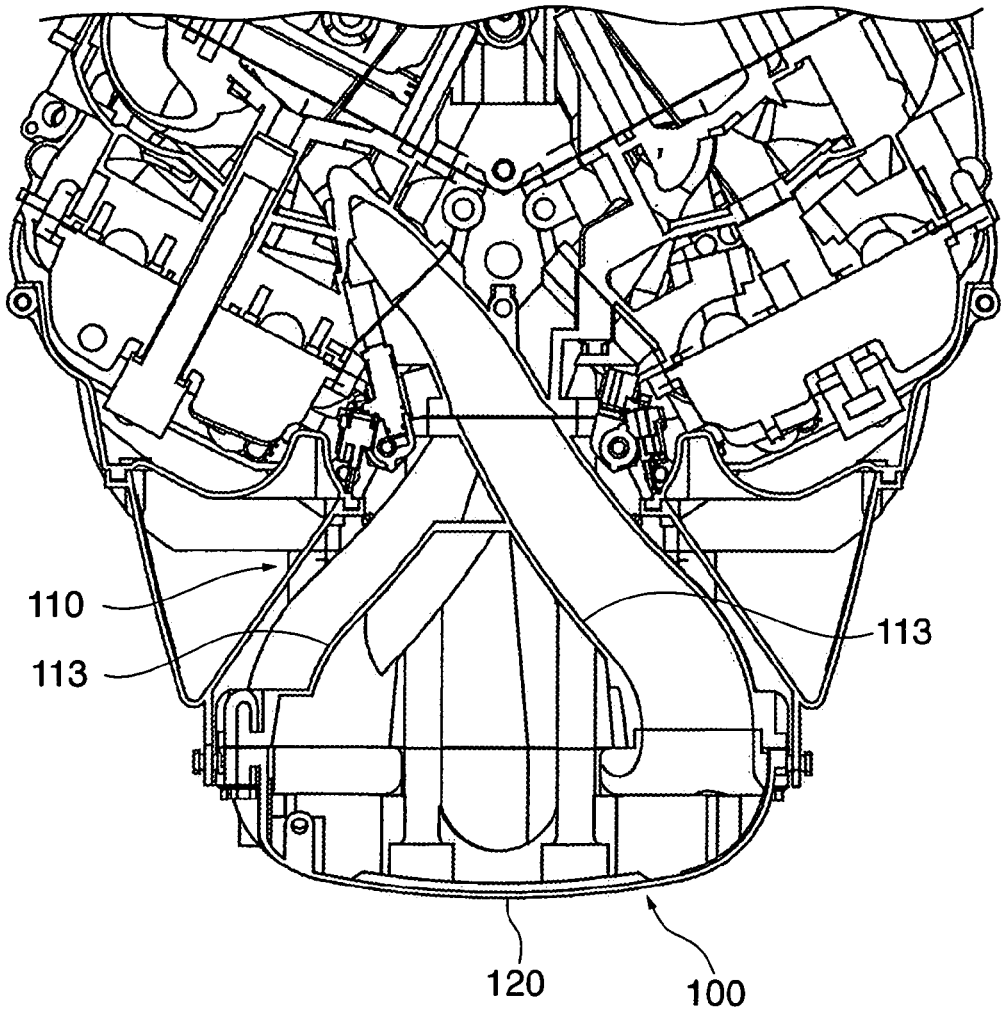
FIG. 5 is a horizontal cross-sectional view of the engine of the outboard motor in FIG. 1.
Figure 6:
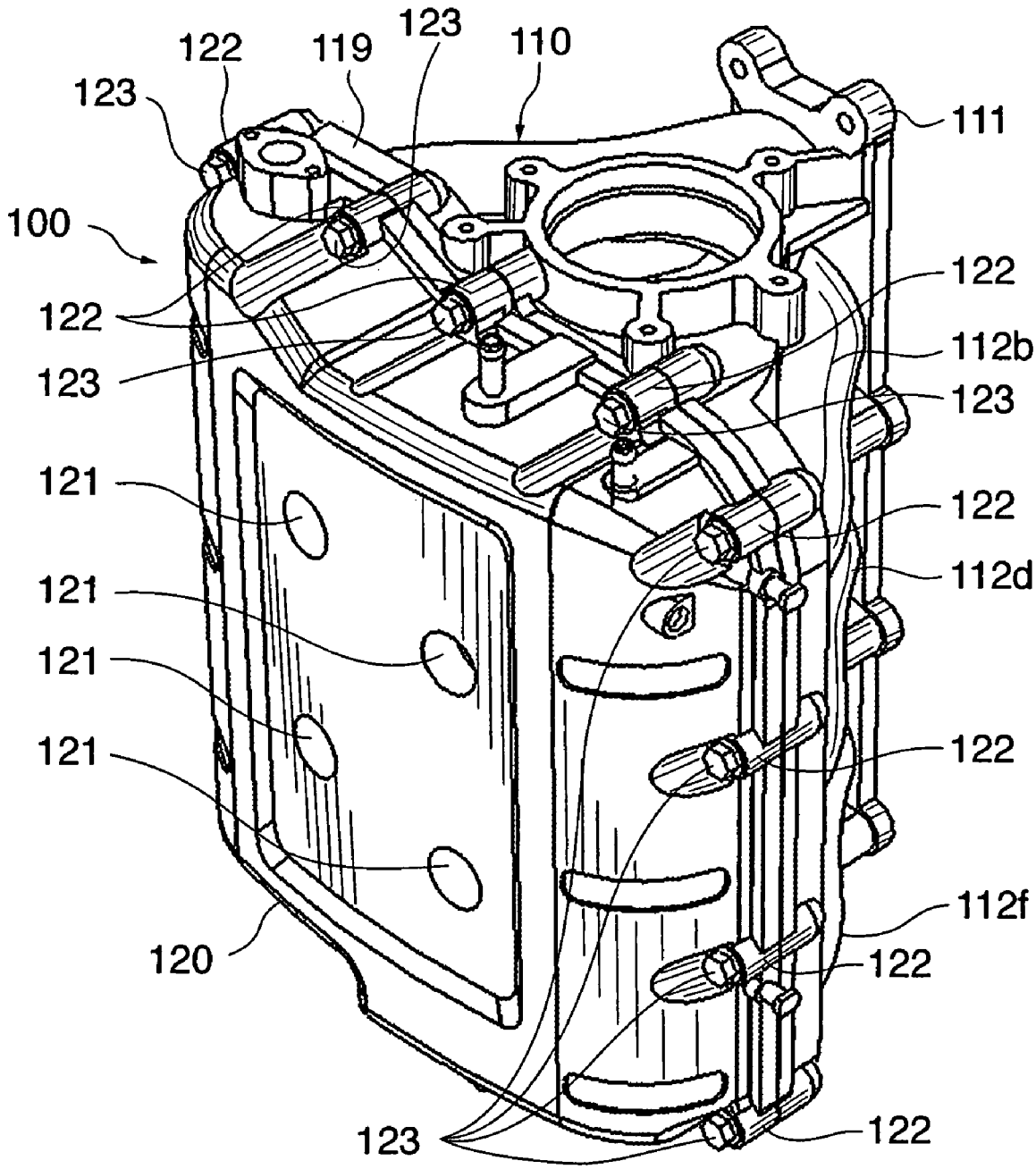
FIG. 6 is a perspective view of a surge tank of the engine in FIG. 3.
Figure 7:
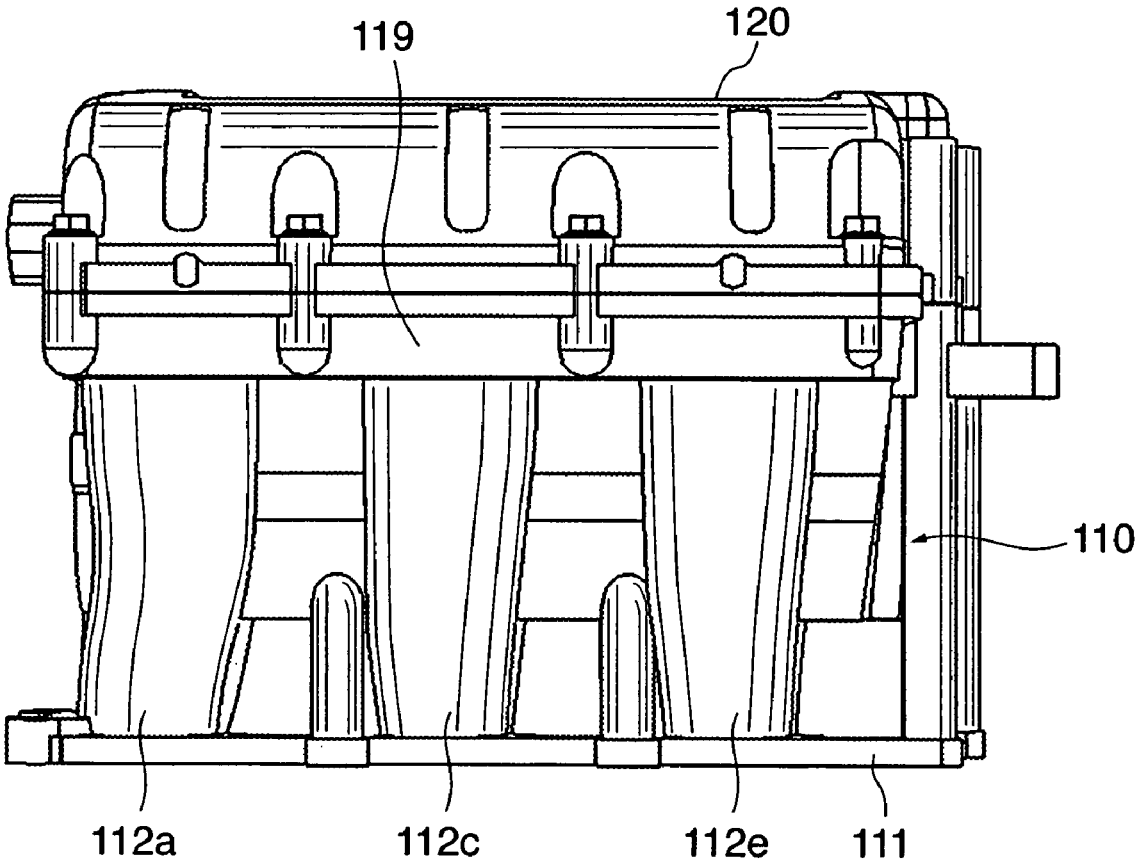
FIG. 7 is a left side view of the surge tank in FIG. 6.

FIG. 3 is a left rear perspective view of the engine 2. FIG. 4 is a top view of the engine 2, and FIG. 5 is a horizontal cross-sectional view of the same. FIG. 6 is a perspective view of the surge tank 100, and FIG. 7 is a left side view of the same. It should be noted that in FIGS. 3 and 4, the throttle body 29 is not shown.

As shown in FIGS. 3 to 5, the surge tank 100 is mounted on a vertically extending mounting surface 38*a* of a flange 38 of the intake manifold 37, which laterally extends to form respective small angles with the cylinder heads 80R and 80L. In the engine 2, the surge tank 100 protrudes rearward from between the cylinder banks 50R and 50L.

As shown in FIGS. 3 to 7, the surge tank 100 is comprised of a surge tank body 110, and a lid member 120 hermetically closing the surge tank body 110.

Figure 8:
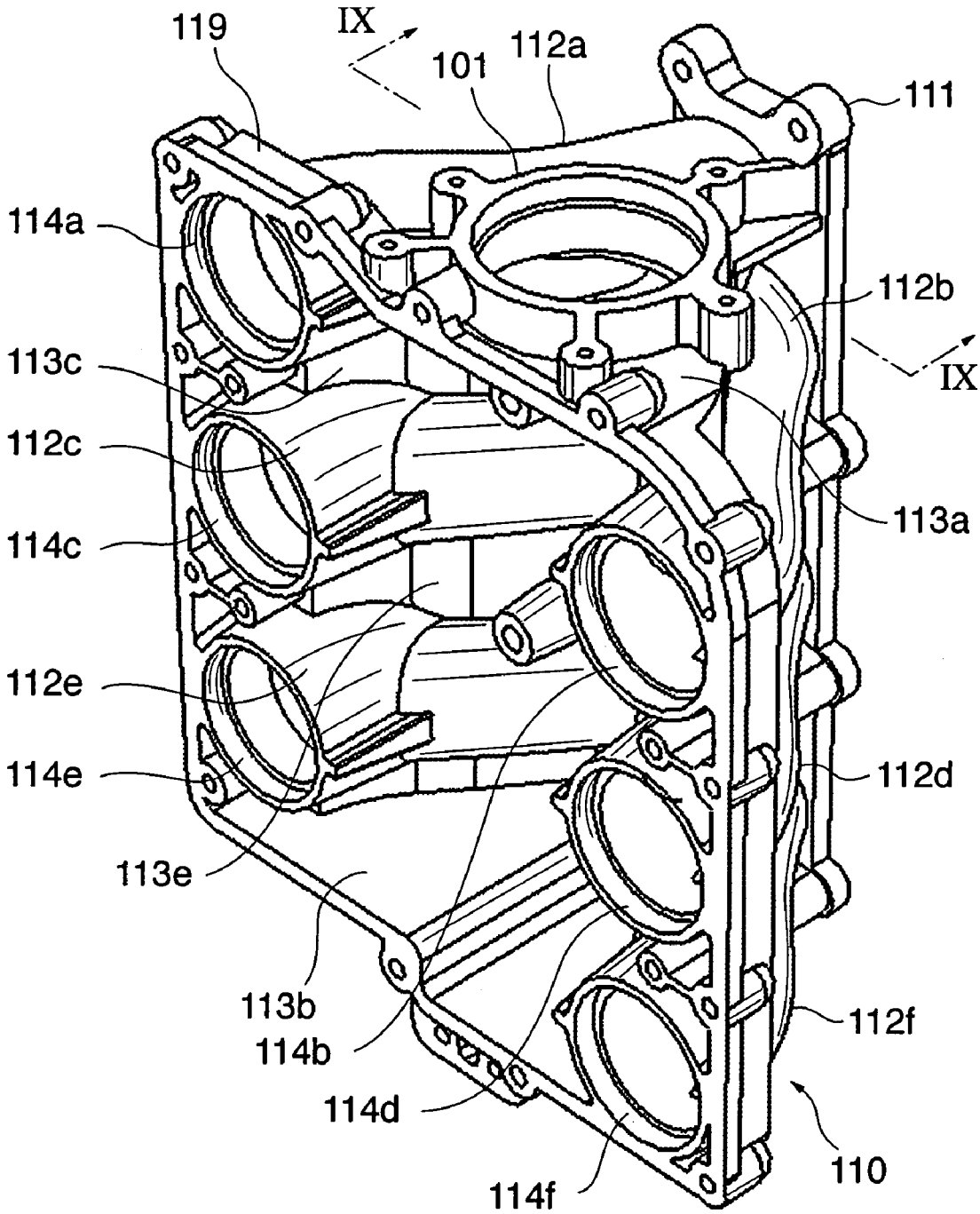
FIG. 8 is a perspective view of a surge tank body of the surge tank in FIG. 6.
Figure 9:
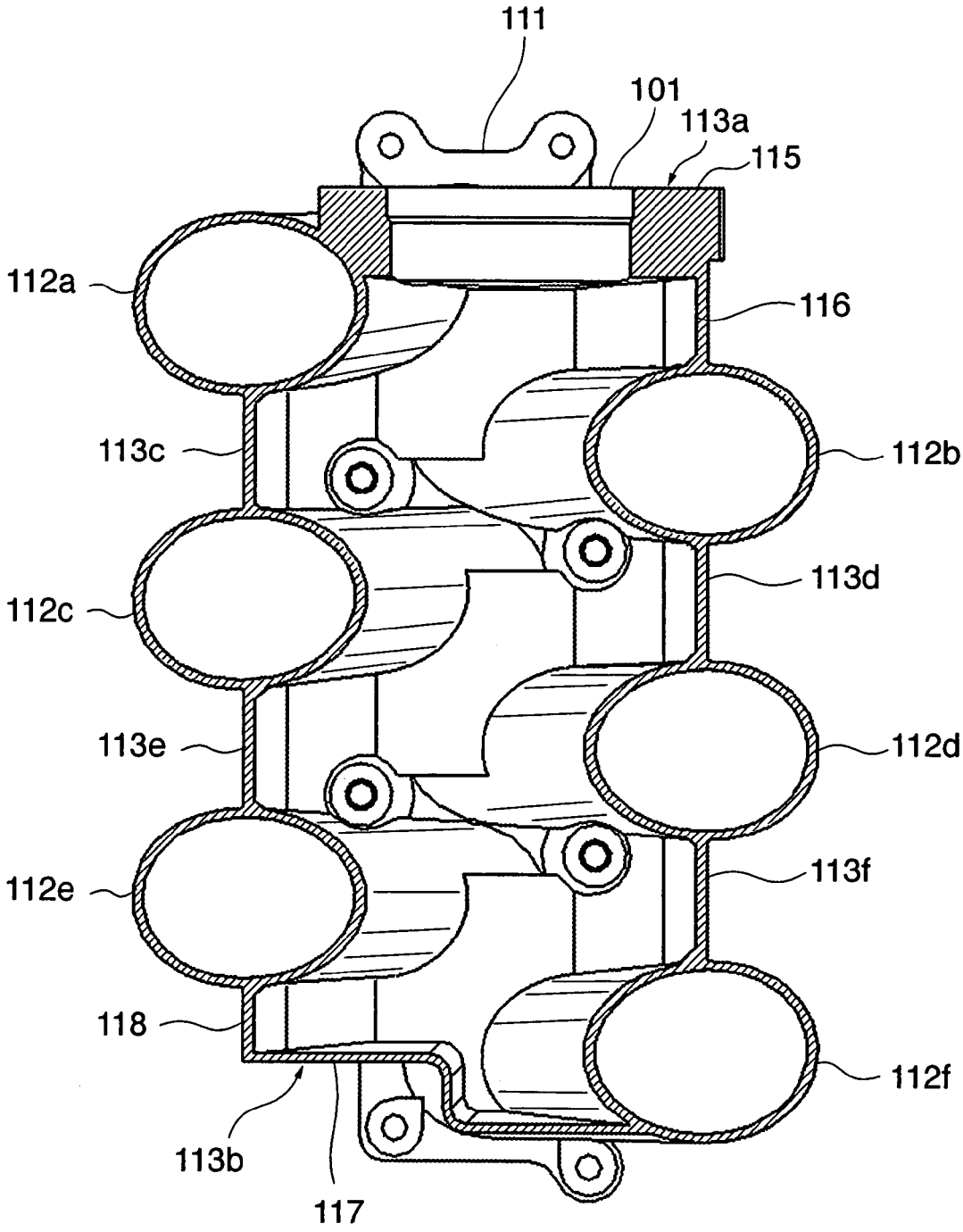
FIG. 9 is a cross-sectional view taken on line IX-IX of FIG. 8.

FIG. 8 is a perspective view of the surge tank body 110, and FIG. 9 is a cross-sectional view taken on line IX-IX of FIG. 8.

As shown in FIGS. 6 to 9, the surge tank body 110 is comprised of a flange 111 hermetically mounted on the flange 38 of the intake manifold 37, intake passage members 112 connected to the respective cylinder bores 51 via the intake manifold 37, and wall members 113 each provided between adjacent two of the intake passage members 112. The flange 111, the intake passage members 112, and the wall members 113 are integrally formed with each other. As shown in FIG. 8, the surge tank body 110 is in the form of a hollow trapezoidal prism having an open rear end face.

Specifically, as shown in FIGS. 8 and 9, in the engine 2, the intake passage members 112 are formed, respectively, as a first intake passage member 112*a* connected to a left uppermost cylinder bore 51, a second intake passage member 112*b* connected to a right uppermost cylinder bore 51, a third intake passage member 112*c* connected to a left central cylinder bore 51, a fourth intake passage member 112*d* connected to a right central cylinder bore 51, a fifth intake passage member 112*e* connected to a left lowermost cylinder bore 51, and a sixth intake passage member 112*f* connected to a right lowermost cylinder bore 51.

The intake passage members 112 are identical in shape and each formed by a generally linearly-extending hollow cylindrical member having a circular shape in cross section. Each intake passage member 112 has the flange 111 at a front end thereof and opens in the front surface of the flange 111. In a state where the surge tank body 110 is mounted to the intake manifold 37 via the flange 111, each of the intake passage members 112 is disposed on substantially the same axis as an associated one of the intake-passage members 37*a* of the manifold 37, such that the inner passage thereof generally linearly communicates with the inner passage thereof the intake passage member 37*a* (see FIG. 2). As shown in FIG. 2, each of the intake passage members 37*a* of the manifold 37 is disposed on substantially the same axis as an associated one of the intake ports 89. Accordingly, each intake passage member 112 is disposed on substantially the same axis as an associated one of the intake ports 89, such that the inner passage thereof generally linear communicates with the inner passage of the associated intake passage member 37*a* and the associated intake port 89. Further, the intake passage members 112 have respective rear ends thereof formed with respective rear end openings 114 (114*a* to 114*f*) which open rearward (see FIG. 8).

As shown in FIGS. 8 and 9, the wall members 113 are formed as wall members 113*a*, 113*b*, 113*c*, 113*d*, 113*e*, and 113*f* having a generally flat plate shape and hermetically closing the sides of the surge tank body 110 except the rear side of the same. Specifically, the wall member 113*a* connects and hermetically closes between the first intake passage member 112*a*, the second intake passage member 112*b*, and the flange 111. The wall member 113*a* is comprised of a top flat-plate member 115 extending generally horizontally from the first intake passage member 112*a*, and a side flat-plate member 116 extending vertically upward from the second intake passage member 112*b* and connecting between the second intake passage member 112*b* and the right end of the top flat-plate member 115. In an approximately central part of the top flat-plate member 115 of the wall member 113*a*, there is formed a hollow cylindrical opening portion 101 that protrudes and opens vertically upward.

The wall member 113*b* connects and hermetically closes between the fifth intake passage member 112*e*, the sixth intake passage member 112*f*, and the flange 111. The wall member 113*b* has substantially the same shape as the wall member 113*a*, and is comprised of a bottom flat-plate member 117 extending generally horizontally from the sixth intake passage member 112*f*, and a side flat-plate member 118 extending vertically downward from the fifth intake passage member 112*e* and connecting between the fifth intake passage member 112*e* and the left end of the bottom flat-plate member 117.

The wall member 113*c* is a flat-plate member extending vertically to connect and hermetically close between the first intake passage member 112*a*, the third intake passage member 112*c*, and the flange 111. The wall member 113*d* is a flat-plate member extending vertically to connect and hermetically close between the second intake passage member 112*b*, the fourth intake passage member 112*d*, and the flange 111. The wall member 113*e* is a flat-plate member extending vertically to connect and hermetically close between the third intake passage member 112*c*, the fifth intake passage member 112*e*, and the flange 111. The wall member 113*f* is a flat-plate member extending vertically to connect and hermetically close between the fourth intake passage member 112*d*, the sixth intake passage member 112*f*, and the flange 111.

Further, as shown in FIG. 8, the surge tank body 110 has a flange 119 integrally formed with the upper end faces of the respective wall members 113*a* to 113*f* so as to accommodate the rear end openings 114 of the respective intake passage members 112. The flange 119 forms a rear end edge of the surge tank body 110 such that the rid member 120 can be hermetically mounted to the surge tank body 110.

As described above, in the surge tank body 110, the outer peripheral surface of the first intake passage member 112*a* and the top flat-plate member 115 of the wall member 113*a* form an upper surface, and the outer peripheral surface of the sixth intake passage member 112*f* and the bottom flat-plate member 117 of the wall member 113*b* form a lower surface. The outer peripheral surfaces of the respective first, third, and fifth intake passage members 112*a*, 112*c*, and 112*e*, the side flat-plate member 118 of the wall member 113*b*, and the wall members 113*c* and 113*e* form a left side surface, and the outer peripheral surfaces of the respective second, fourth, and sixth intake passage members 112*b*, 112*d*, and 112*f*, the side flat-plate member 116 of the wall member 113*a*, and the wall members 113*d* and 113*f* form a right side surface, with the flange 111 forming a front surface. In short, the outer peripheral surfaces of the intake passage members 112, the wall members 113, and the flange 111 define a space in the form of a generally trapezoidal prism.

The lid member 120 is in the form of a hollow rectangular parallelepiped having an open front end face, as shown in FIGS. 6 and 7, and the front end edge of the lid member 120 is formed such that it is hermetically brought into contact with the flange 119 of the surge tank body 110.

Figure 10:
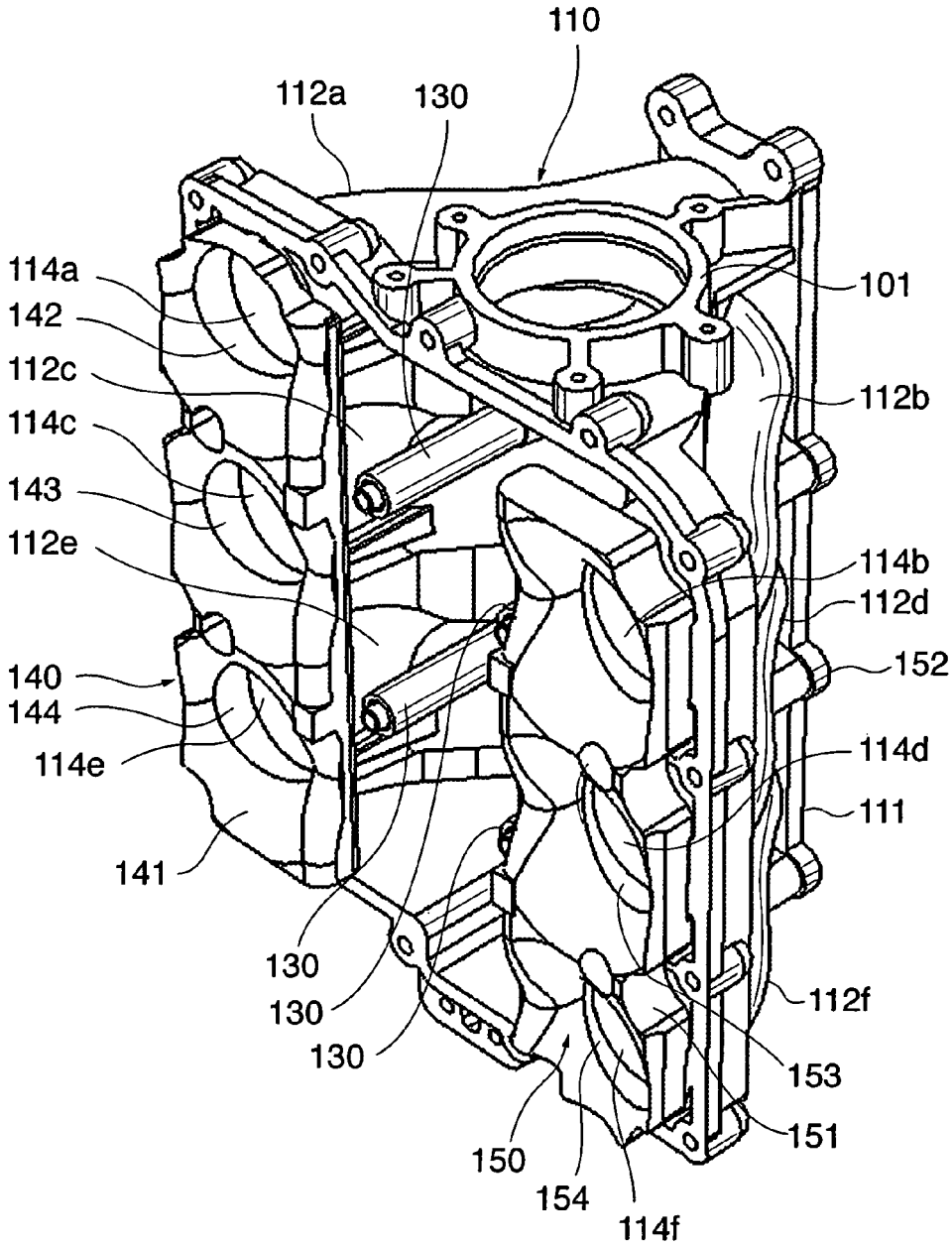
FIG. 10 is an exploded perspective view showing component parts of the surge tank in FIG. 6.

Further, the surge tank 100 has spacers 130 formed within the surge tank body 110, for use in mounting the lid member 120 on the surge tank body 110. Each of the spacers 130 is erected on the associated wall member 113 and extends perpendicularly to the flange 111 as shown in FIG. 10. The surge tank 100 has e.g. four spacers 130 screwed to bosses formed on the respective wall members 113*c*, 113*d*, 113*e*, and 113*f*. It should be noted that the surge tank 100 may have bosses formed on the respective wall members 113 so as to mount the lid member 120 on the surge tank body 110, in place of the spacers 130.

Furthermore, as shown in FIG. 10, the surge tank 100 is provided with a pair of left and right funnels 140 and 150 for rectifying the flow of intake air. The funnel 140 for the left bank is formed by a plate-shaped member 141 formed with funnel-shaped openings 142, 143, and 144 associated with the respective first, third, and fifth intake passage members 112*a*, 112*c*, and 112*e*. Each of the openings 142, 143, and 144 has a front end thereof formed to have approximately the same diameter as that of an associated one of the openings 114*a*, 114*c*, and 114*e* of the respective first, third, and fifth intake passage members 112*a*, 112*c*, and 112*e*, and a rear end thereof formed to have a larger diameter than the front end. The openings 142, 143, and 144 are formed to extend in a manner smoothly connecting between the rear side to the front side. More specifically, the openings 142, 143, and 144 each have a bell mouth-like shape, and the funnel 140 is mounted in the surge tank body 110 by fitting the front end of each of the openings 142, 143, and 144 on an associated one of the openings 114*a*, 114*c*, and 114*e* of the respective intake passages members.

The funnel 150 for the right bank is formed in line-symmetrical relation to the funnel 140 for the left bank. Similarly to the funnel 140, the funnel 150 is formed by a plate-shaped member 151 formed with funnel-shaped openings 152, 153, and 154 corresponding to the respective second, fourth, and sixth intake passage members 112*b*, 112*d*, and 112*f*. It should be noted that the surge tank 100 is not limited to one provided with the above-described funnels 140 and 150, but may be one having funnels different in shape from the funnels 140 and 150.

The surge tank 100 is assembled by mounting the spacers 130 and the funnels 140 and 150 for the respective left and right banks, in the surge tank body 110, as shown in FIG. 10, and hermetically and rigidly joining the surge tank body 110 and the lid member 120 to each other via the flange 119 of the surge tank body 110 and the front edge of the lid member 120 by screwing a bolt into each of the spacers 130 via an associated one of holes 121 of the lid member 120 and screwing a plurality of bolts 123 into the flange 119 via a plurality of bosses 122 on the front edge of the lid member 120, as shown in FIG. 6.

In the engine 2, as shown in FIG. 4, the surge tank 100 is mounted to the intake manifold 37 by having the flange 111 thereof hermetically and rigidly joined to the flange 38 of the intake manifold 37. Further, in the surge tank 100, the throttle body 29 is mounted in the opening 101 formed in the top wall member 113*a* (see FIG. 2). Thus, in the outboard motor 1, the inner space of the surge tank 100 defined by the surge tank body 110 and the lid member 120 is sealed.

As described above, in the surge tank 100, the wall members 113 are each provided between adjacent two of the intake passage members 112 to cooperatively define a box-shaped space together with the lid member 120. Thus, the surge tank 100 utilizes the space, which exists only as a dead space in the conventional outboard motors, as part of the surge tank. This makes it possible to increase the capacity of the surge tank, thereby enhancing the air intake performance of the intake device. In addition, since the surge tank 100 utilizes the dead space as part thereof, sufficient capacity can be secured without forming the surge tank such that it protrudes in the transverse or rearward direction as in the conventional the intake air device. Therefore, it is possible to achieve size reduction and make the outline of the engine 2 compact in size.

Further, since the throttle body 29 is disposed on the upper surface of the surge tank 100, the outline of the engine 2 can be made more compact in size.

In the surge tank 100 constructed as above, when the engine 2 is in operation, outside air supplied from the throttle body 29 is stored in the inner space. Then, when the pressure within each of the cylinder bores 51 is reduced to a negative pressure according to the motion of an associated piston 53, the outside air stored in the inner space is supplied to the combustion chamber 52 of the cylinder bore 51 through an associated one of the openings 142 to 144 of the funnel 140 and the openings 152 to 154 of the funnel 150, an associated one of the intake passage members 112*a* to 112*f*, the intake manifold 37, and an associated one of the intake ports 89. At this time, the air supplied from the inner space of the surge tank 100 to each of the intake passage members 112 through the associated one of the openings 142 to 144 of the funnel 140 and the openings 152 to 154 of the funnel 150 has its flow rectified by the associated one of the bell mouth-like openings 142 to 144 and 152 to 154. Further, since each of the intake passage members 112, an associated one of the intake passage members 37*a* of the intake manifolds 37, and an associated one of the intake ports 89 are arranged in coaxial relation and linearly connected to each other, it is possible to reduce intake resistance. This makes it possible to supply outside air from the inner space of the surge tank 100 to the combustion chambers 52 efficiently. Therefore, the intake efficiency of the intake device can be further enhanced.

Further, since the surge tank 100 has the inner space defined using the intake passage members 112, the intake passage members 112 can be made longer, which makes it possible to enhance the intake efficiency of the intake device.

Furthermore, the surge tank 100 is comprised of the surge tank body 110 and the lid member 120 formed as respective separate members, so that the lid member 120 can be easily removed from the surge tank 100 even in the state of the surge tank 100 mounted in the outboard motor 1. This facilitates removal of the funnels 140 and 150 and replacement of the funnels with ones having a different shape, thereby making it possible to enhance the intake efficiency of the intake device.

What is more, the surge tank 100 can be treated as a one-piece assembly after the surge tank body 110, the lid member 120, and the funnels 140 and 150 are assembled. Therefore, it is not required to remove the lid member 120 before mounting the surge tank 100 in the engine 2, which contributes to improvement of assemblability.

Next, a description will be given of the construction of the throttle body 29.

Figure 14:
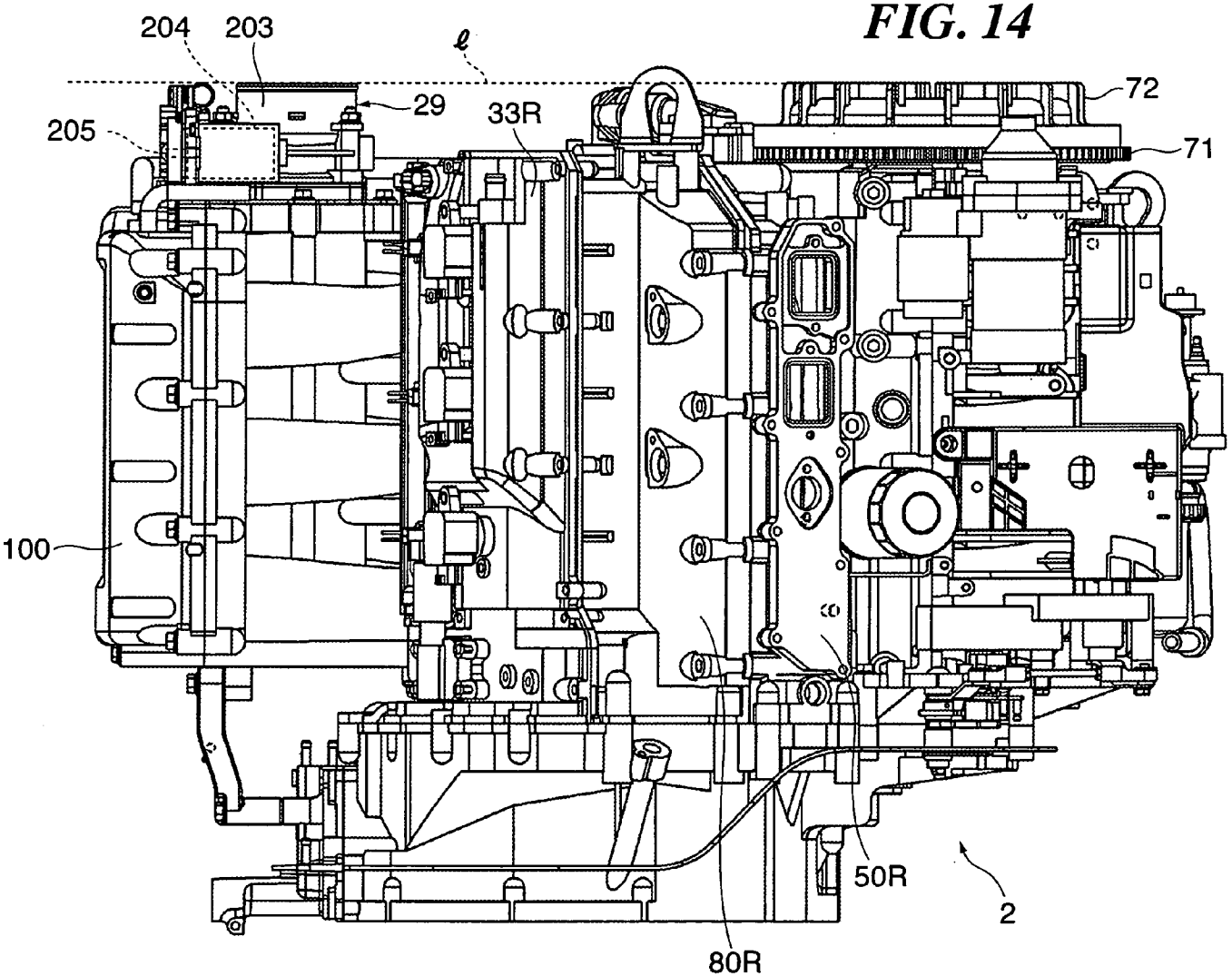
FIG. 14 is a right side view of an engine of the outboard motor in FIG. 1.
Figure 15:
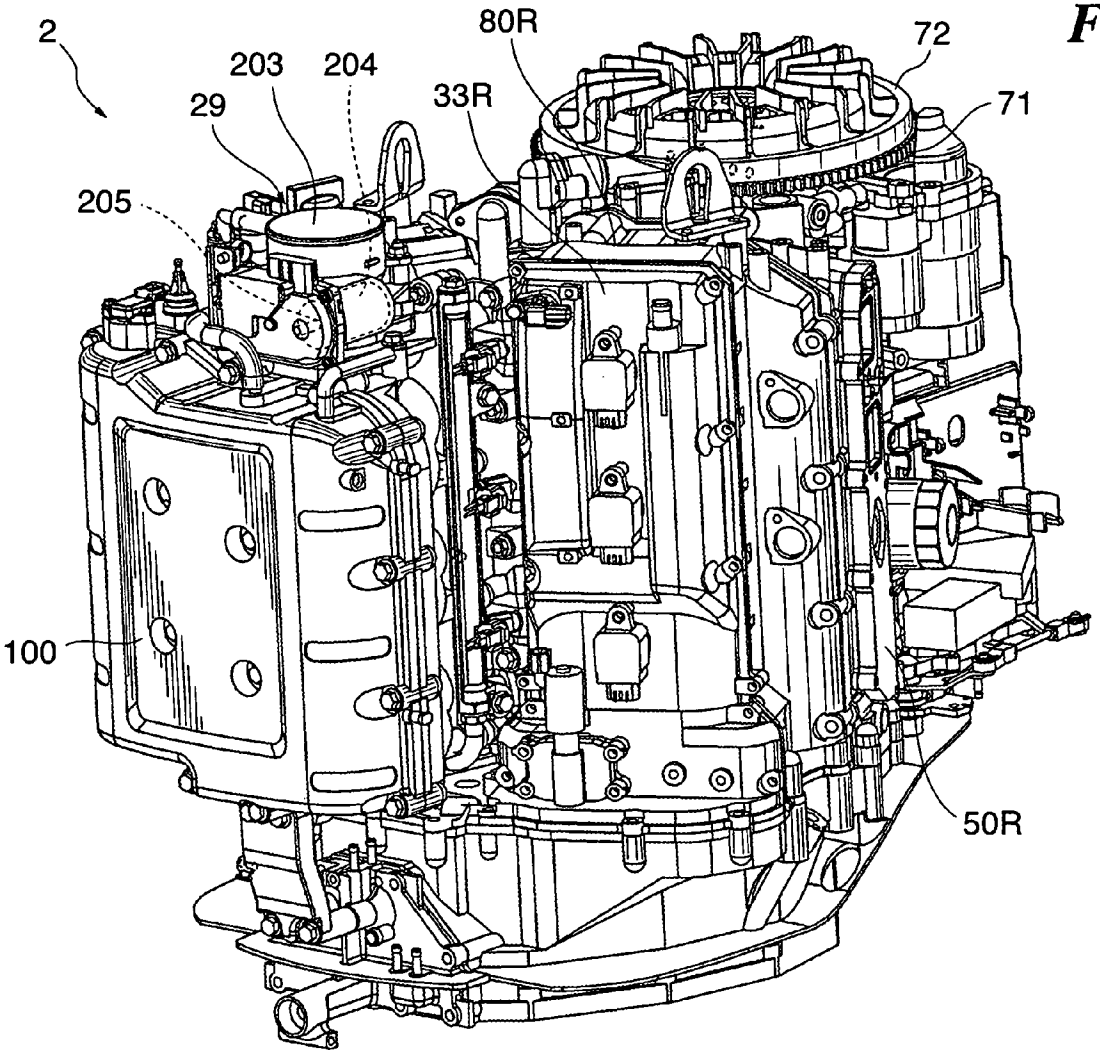
FIG. 15 is a right rear perspective view of the engine of the outboard motor in FIG. 1.

FIG. 14 is a right side of the engine 2, and FIG. 15 is a right rear perspective view of the engine 2.

The throttle body 29 is an electronically-controlled throttle body, and is comprised of a throttle valve 201, a throttle shaft 202, an intake passage member 203, and a throttle motor 204, as shown in FIGS. 2, and 14 to 16. These components are integrally assembled.

As shown in FIG. 2, the throttle body 29 is mounted on the upper surface of the surge tank 100 via a rubber damper (insulator) and a gasket approximately in the transverse center between the two cylinder banks of the V bank. The rubber damper prevents transfer of vibration and heat from the engine, and the gasket hermetically seals the connection between the surge tank 100 and the throttle body 29.

The intake passage member 203 is formed by a hollow cylindrical member circular in cross section and extending substantially linearly in the vertical direction. The intake passage member 203 has open upper and lower ends, and the lower end thereof is hermetically mounted in the opening portion 101 of the upper surface of the surge tank 100 via the gasket such that the inner passage of the intake passage member 203 can communicate with the inside of the surge tank 100.

The throttle valve 201 is disposed in the intake passage member 203, and the throttle shaft 202 horizontally extending in the longitudinal direction of the outboard motor 1 is integrally mounted to the throttle valve 201. The throttle valve 201 is generally identical in cross-sectional shape to the intake passage member 203, and is pivotally supported on the throttle shaft 202. That is, the throttle valve 201 makes it possible to causes the inner passage of the intake passage member 203 to be opened and closed by drivingly rotating the throttle shaft 202.

The throttle motor 204 has a throttle motor shaft 205 horizontally extending in the longitudinal direction of the outboard motor 1. That is, the throttle motor shaft 205 extends parallel with the throttle shaft 202. The throttle motor shaft 205 is connected to the throttle shaft 202 via an idle gear 206.

Further, the throttle body 29 is disposed at such a location that an upper end face thereof, i.e. an upper end face of the intake passage member 203, does not protrude higher than the upper end of the magnet device 72 as a rotary member mounted on the upper end of the crankshaft 32 (see line 1 in FIG. 14).

In the throttle body 29 constructed as above, when the throttle motor 204 is driven by the control of an engine control unit (ECU), the throttle motor shaft 205 rotates to cause rotation of the throttle shaft 202 via the idle gear 206, whereby the throttle valve 201 is driven to open/close the intake passage member 203. The throttle body 29 has a throttle position sensor, not shown, attached thereto for detecting the degree of opening of the throttle valve 201, and the ECU drivingly controls the throttle motor 204 based on a value of the degree of opening detected by the throttle position sensor to thereby control the throttle valve 201 to a desired opening degree.

The throttle body 29, which is an electronically-controlled throttle body as described above, can dispense with levers or a linkage differently from mechanical types, and hence the vertical dimension of the throttle body can be reduced, which makes it possible to reduce the size of the intake device. Thus, it is possible to achieve reduction of the height of the throttle body 29 in the engine 2, thereby making the outline of the engine 2 compact in size.

Further, since the throttle body 29 is directly mounted on the upper surface of the surge tank 100, the height of the throttle body 29 can be made lower, which contributes to reduction of the size of the intake device.

Furthermore, since the intake passage member 203 of the throttle body 29 extends substantially linearly in the vertical direction, the height of the throttle body 29 can be made lower, which makes it possible to reduce the size of the intake device.

The throttle body 29 is disposed, as described hereinbefore, at such a location that the upper end face thereof i.e. the upper end face of the intake passage member 203 does not protrude higher than the magnet device 72 as a rotary member mounted on the upper end of the crankshaft 32. Therefore, it is possible to reduce the size of the intake device, thereby making the outline of the engine 2 compact in size.

Further, the throttle body 29 is directly mounted on the upper surface of the surge tank 100 approximately in the transverse center between the two cylinder banks of the V bank as described hereinabove (see FIGS. 2 and 14), it is possible to smoothly supply outside air to each of the cylinder bores.

Moreover, in the throttle body 29, the throttle shaft 202 and the throttle motor shaft 205 are disposed such that they horizontally extend parallel with each other in the longitudinal direction of the engine 2, gravity equally acts on the two shafts, which makes it possible to reduce load applied on journal bearings of the respective shafts. This makes it possible to improve the operability and durability of the throttle valve 201 and the throttle motor 204.

Next, a description will be given of other component parts of the intake device.

Figure 11:
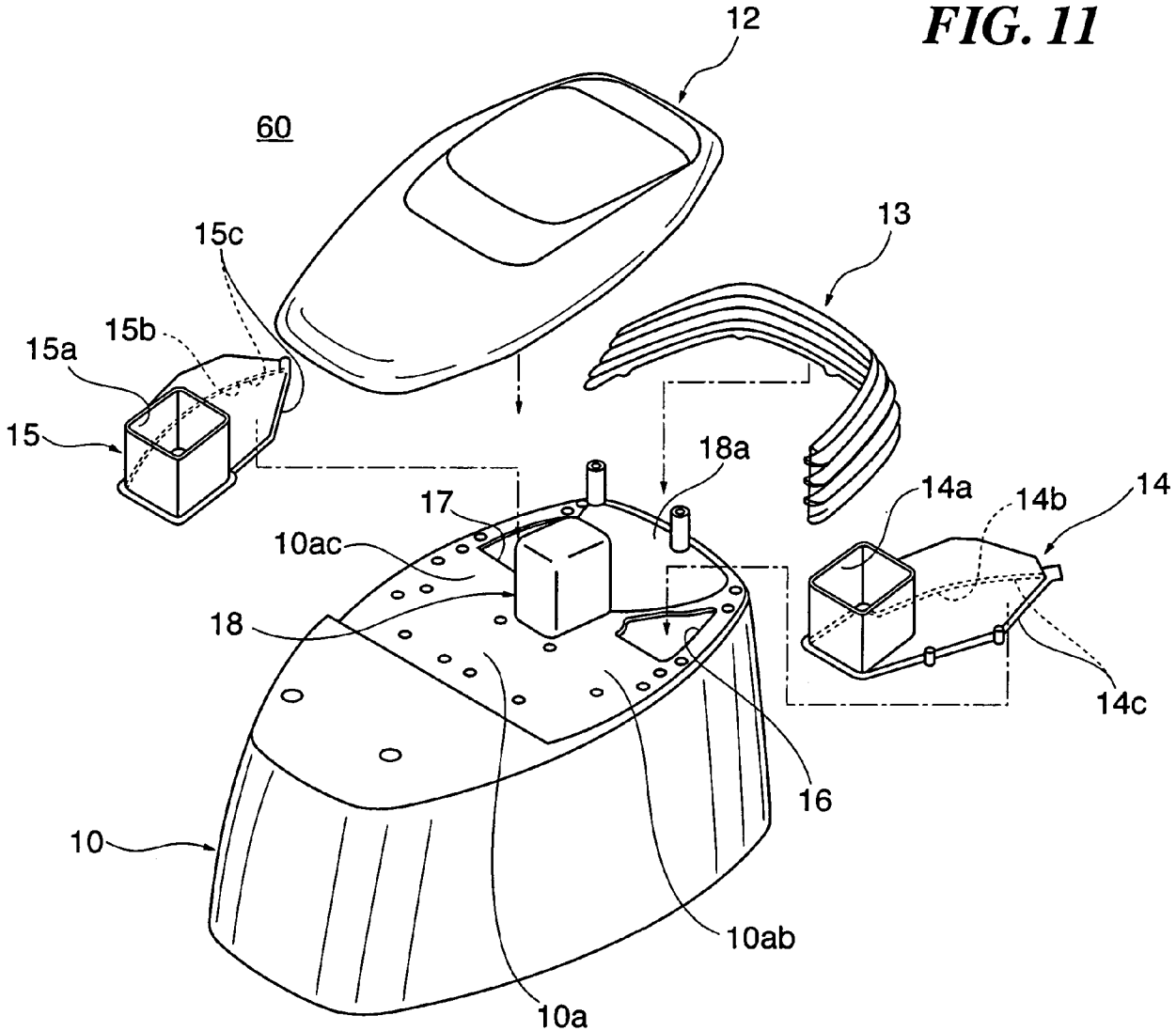
FIG. 11 is an exploded perspective view of an engine cover assembly comprising an upper cover and component parts associated therewith.
Figure 13:
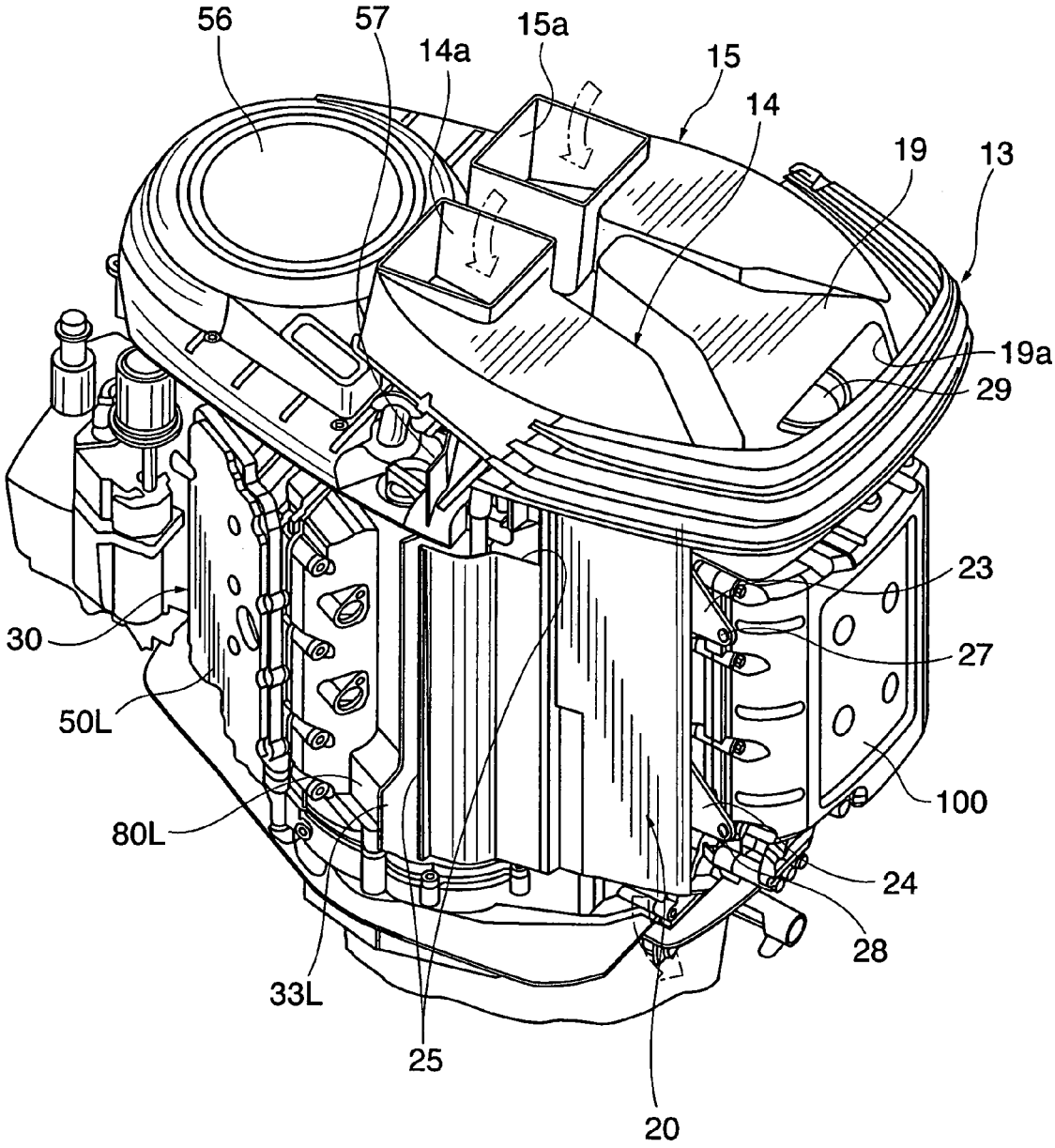
FIG. 13 is a perspective view of the upper half of the outboard motor with a louver and left and right air intake guides, which are not shown in FIG. 12, mounted thereon.
Figure 16:
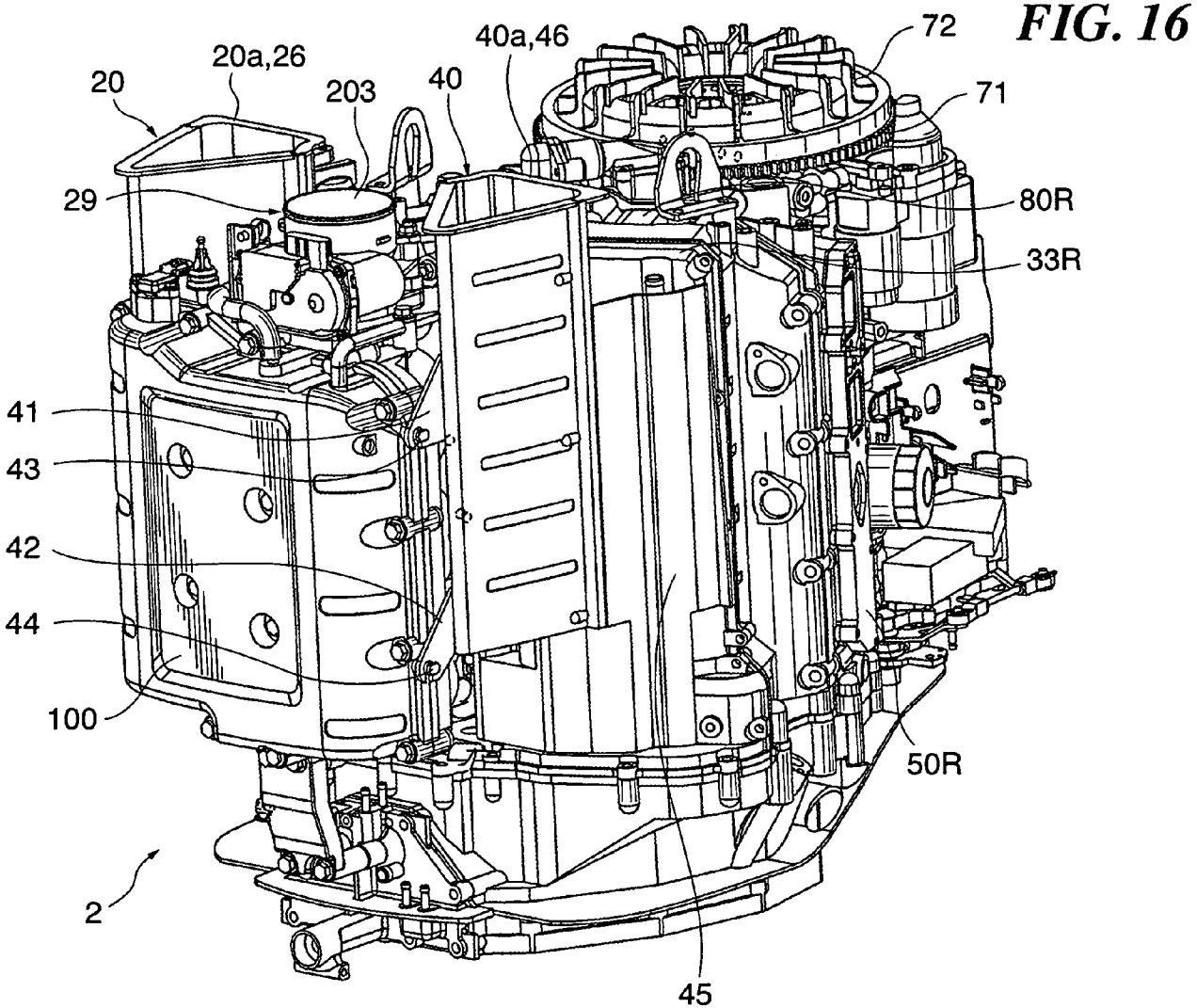
FIG. 16 is a perspective view of the appearance of the engine of the outboard motor in FIG. 1, with air intake ducts mounted thereto.

FIG. 11 is an exploded perspective view of an engine cover assembly comprised of the upper cover 10 and component parts associated therewith. FIG. 12 is a perspective view of the appearance of an upper half of the outboard motor 1 in a state where the engine cover assembly 60 is removed, and FIG. 13 is a perspective view of the upper half of the outboard motor 1 with the louver 13 and left and right air intake guides, which are not shown in FIG. 12, mounted thereon. FIG. 16 is a perspective view of the appearance of the engine of the outboard motor, with air intake ducts mounted thereto.

As shown in FIG. 11, the engine cover assembly 60 is formed by mounting the top cover 12, the louver 13, and the left and right air intake guides 14 and 15 on the upper cover 10. Besides these, there are component parts mounted on the upper cover 10, but representation and description thereof will be omitted.

The upper cover 10 has a cover part 18 integrally formed therewith in the center of a rear part of an upper surface 10*a* thereof, for covering the silencer 19 (see FIG. 12). In the rear part of the upper surface 10*a* of the upper cover 10, generally triangular holes 16 and 17 are formed in the respective left and right portions of the cover part 18. The air intake guides 14 and 15 have respective front parts thereof formed with upwardly open square upper opening parts 14*a* and 15*a*, respectively. The upper opening part 14*a* is formed on the front part of the left air intake guide 14 in a manner slightly shifted rightward with respect to the center thereof (i.e. at a location shifted toward the center of the upper cover 10), while the upper opening part 15*a* is formed on the front part of the right air intake guide 15 in a manner slightly shifted leftward with respect to the center thereof (i.e. at a location shifted toward the center of the upper cover 10). Further, the air intake guides 14 and 15 are formed with longitudinally elongated lower openings 14*b* and 15*b*, respectively, each of which has an outer edge formed by an associated one of lower edges 14*c* and 15*c* of the respective air intake guides 14 and 15, and opens downward. The air intake guides 14 and 15 are formed to be hollow.

Each of the air intake guides 14 and 15 is disposed on the upper surface 10*a* of the upper cover 10 in a manner covering an associated one of forward-of-hole portions 10*ab* and 10*ac* extending forward from the respective holes 16 and 17 and an associated one of the holes 16 and 17, and is rigidly secured to the upper surface 10*a* by screws, not shown. In doing this, contact portions between the upper surface 10*a* of the upper cover 10 and the respective lower edges 14*c* and 15*c* are each sealed e.g. by a liquid gasket. As a consequence, the forward-of-hole portions 10*ab* and 10*ac* provide partitioning walls on the front halves of the respective lower openings 14*b* and 15*b*, so that there are formed respective substantial L-shaped communication passages extending from the upper opening part 14*a* and the upper opening part 15*a* to the holes 16 and 17.

The top cover 12 is rigidly screwed onto the top of the upper cover 10. The louver 13 is rigidly screwed to the rear part of the top cover 12 and that of the upper cover 10.

As shown in FIGS. 2, 12, and 16, in the left and right side portions of the rear part of the engine 2, there are provided left and right air intake ducts 20 and 40, respectively. The air intake ducts 20 are disposed in spaces between the surge tank 100 and the left and right cylinder head covers 33L and 33R. Therefore, the air intake ducts 20 and 40 are substantially received within the general outline of the engine 2, as viewed in plan view (FIG. 2).

Each of the air intake ducts 20 and 40 is a hollow cylindrical member vertically extending to a lower end of the engine 2 and having a generally triangular cross-sectional shape corresponding to an associated one of the holes 16 and 17 of the upper cover 10. The contours of the air intake ducts 20 and 40 are slightly smaller than the holes 16 and 17, respectively. The air intake ducts 20 and 40 have upper ends 20*a* and 40*a* as respective intake ports for taking in outside air, and lower ends as respective discharge ports. Sealing members 26 and 46 are attached to the upper ends 20*a* and 40*a*, respectively.

As shown in FIG. 12, the left air intake duct 20 has a rear part integrally formed with stays 23 and 24. The left air intake duct 20 is fixed to the engine 2 by being rigidly secured to two portions of the head cover 33L by screws 21 and 22, respectively, and to the left side of the surge tank 100 by screws 27 and 28 via the stays 23 and 24, respectively. As shown in FIG. 16, the right air intake duct 40 has a rear part integrally formed with stays 41 and 42. The right air intake duct 40 is fixed to the engine 2 by being rigidly secured to two portions of the head cover 33R by screws (now shown), respectively, and to the right side of the surge tank 100 by screws 43 and 44 via the stays 41 and 42, respectively.

As shown in FIG. 2, the left air intake duct 20 has a partition plate 25 integrally formed therewith and extending from the left side of the front part thereof. The partition plate 25 extends vertically from a location slightly lower than the upper end of the left air intake duct 20 to the lower end of the same, and horizontally extends rearward to cover substantially the entire left side part of the head cover 33L. The front end of the partition plate 25 is close to the upper cover 10, to thereby divide a left-side space under the upper cover 10 into an engine body-side space (i.e. a space from the crankcase 31 to the vicinity of the head cover 33L) which functions as a principal heat source and an intake device-side space (i.e. a space having the intake manifold 37 and the surge tank 100 provided therein). The right air intake duct 40 has a partition plate 45 integrally formed therewith and extending from the left side of the front part thereof. The partition plate 45 extends vertically from a location slightly lower than the upper end of the right air intake duct 20 to the lower end of the same, and horizontally extends rearward to cover substantially the entire right side part of the head cover 33R. The front end of the partition plate 45 is close to the upper cover 10, to thereby divide a right-side space under the upper cover 10 into an engine body-side space (i.e. a space from the crankcase 31 to the vicinity of the head cover 33R) which functions as a principal heat source and an intake device-side space (i.e. a space having the intake manifold 37 and the surge tank 100 provided therein).

Further, the right air intake duct 40 is also formed in laterally symmetrical relation to the left air intake duct 20. The right air intake duct 40 is fixed to the engine 2 by being rigidly secured to two portions of the head cover 33R by screws 41 and 42 (see FIG. 12), respectively, and being rigidly screwed to the right side of the surge tank 100 via respective stays, not shown. The left air intake duct 20 is also formed in laterally symmetrical relation to the right air intake duct 40. The left air intake duct 20 is fixed to the engine 2 by being rigidly secured to two portions of the head cover 33L by screws (see FIG. 9), respectively, and being rigidly screwed to the left side of the surge tank 100 by screws 23 and 24 via respective stays 21 and 42.

The right air intake duct 40 has a partition plate 45 (see FIG. 2) integrally formed therewith and extending from the right side of the front part thereof. The partition plate 45 is formed in laterally symmetrical relation to the partition plate 25. Therefore, the partition plate 45 divides a right-side space under the upper cover 10 into an engine body-side space (i.e. a space from the crankcase 31 to the vicinity of the head cover 33R) and an intake device-side space. Further, the left air intake duct 20 has a partition plate 25 (see FIG. 2) integrally formed therewith and extending from the left side of the front part thereof. The partition plate 25 is formed in laterally symmetrical relation to the partition plate 45. Therefore, the partition plate 25 divides a left-side space under the upper cover 10 into an engine body-side space (i.e. a space from the crankcase 31 to the vicinity of the head cover 33L) and an intake device-side space.

Figure 17:
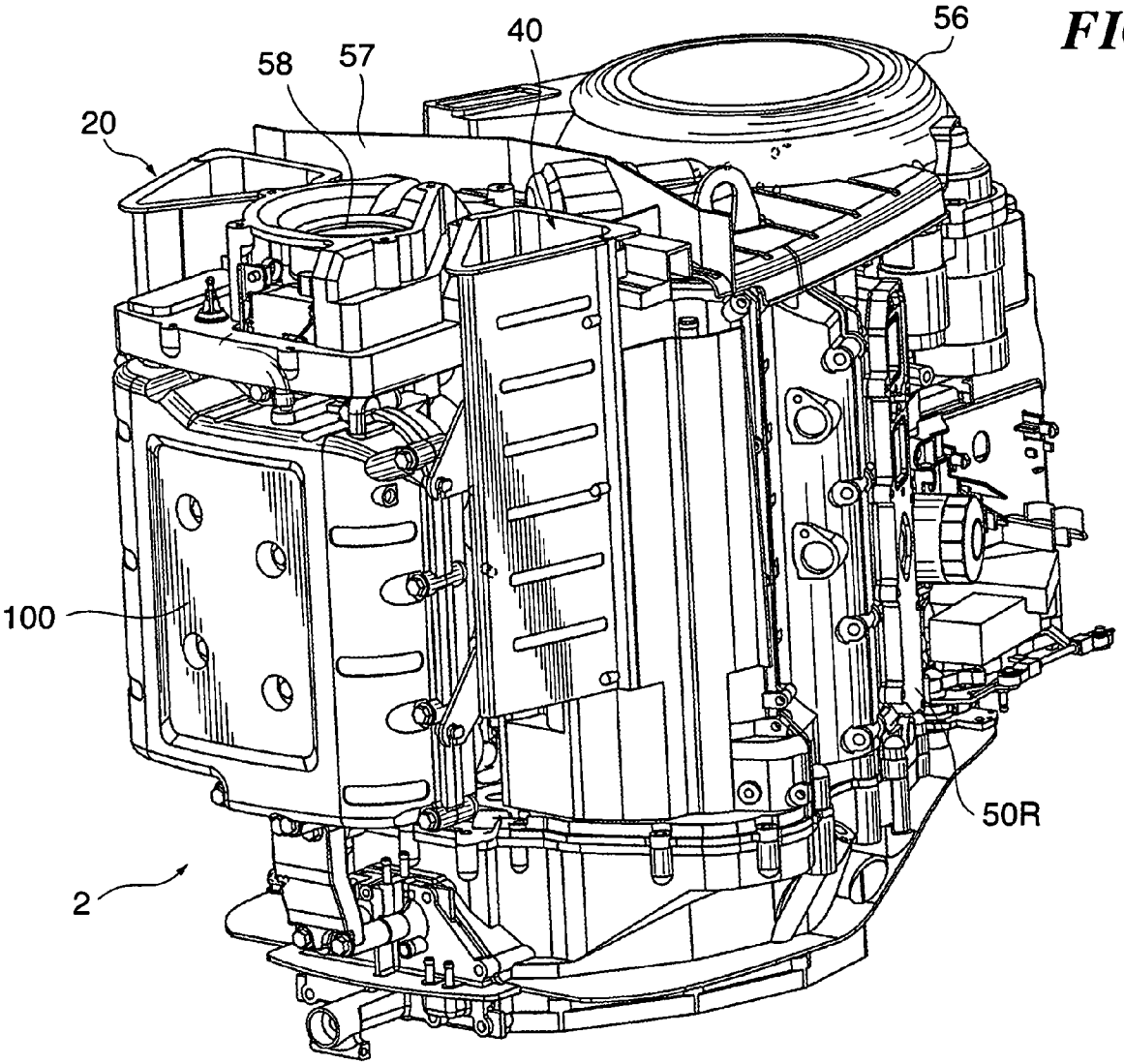
FIG. 17 is a perspective view of the appearance of the engine in FIG. 16, with a flywheel magnet cover mounted thereon.

FIG. 17 is a perspective view of the appearance of the engine 2 in FIG. 16, with a flywheel magnet cover mounted thereon.

As shown in FIG. 17, in the outboard motor 1, the flywheel magnet cover 56 for covering the upper face of the engine 2 is mounted to the engine 2 in a manner covering the flywheel 71, the magnet device 72, and the surge tank 100 from above.

Further, in an upper rear part of a flywheel magnet cover 56 that covers the magnet device, not shown, there is provided an upper partition plate 57 which is generally bow-shaped in plan view (see FIG. 12). The upper partition plate 57 divides an upper space of the engine 2 under the upper cover 10 into an engine body-side space and an intake device-side space. In short, the upper partition plate 57 and the partition plates 25 and 45 cooperate to divide the space under the upper cover 10 into front and rear portions, i.e. the engine body-side space and the intake device-side space. The discharge ports as the lower ends of the respective air intake ducts 20 and 40 are open to the intake device-side space.

Further, a rear end part of the flywheel magnet cover 56, i.e. a portion covering the surge tank 100 and the throttle body 29 is formed with an opening 58 from which extends the intake passage member 203 of the throttle body 29. The opening 58 is formed such that it is vertically open, as shown in FIG. 19, when the flywheel magnet cover 56 is mounted on the engine 2, and the upper end of the intake passage member 203 extending therethrough is open to space above the flywheel magnet cover 56.

Figure 18:
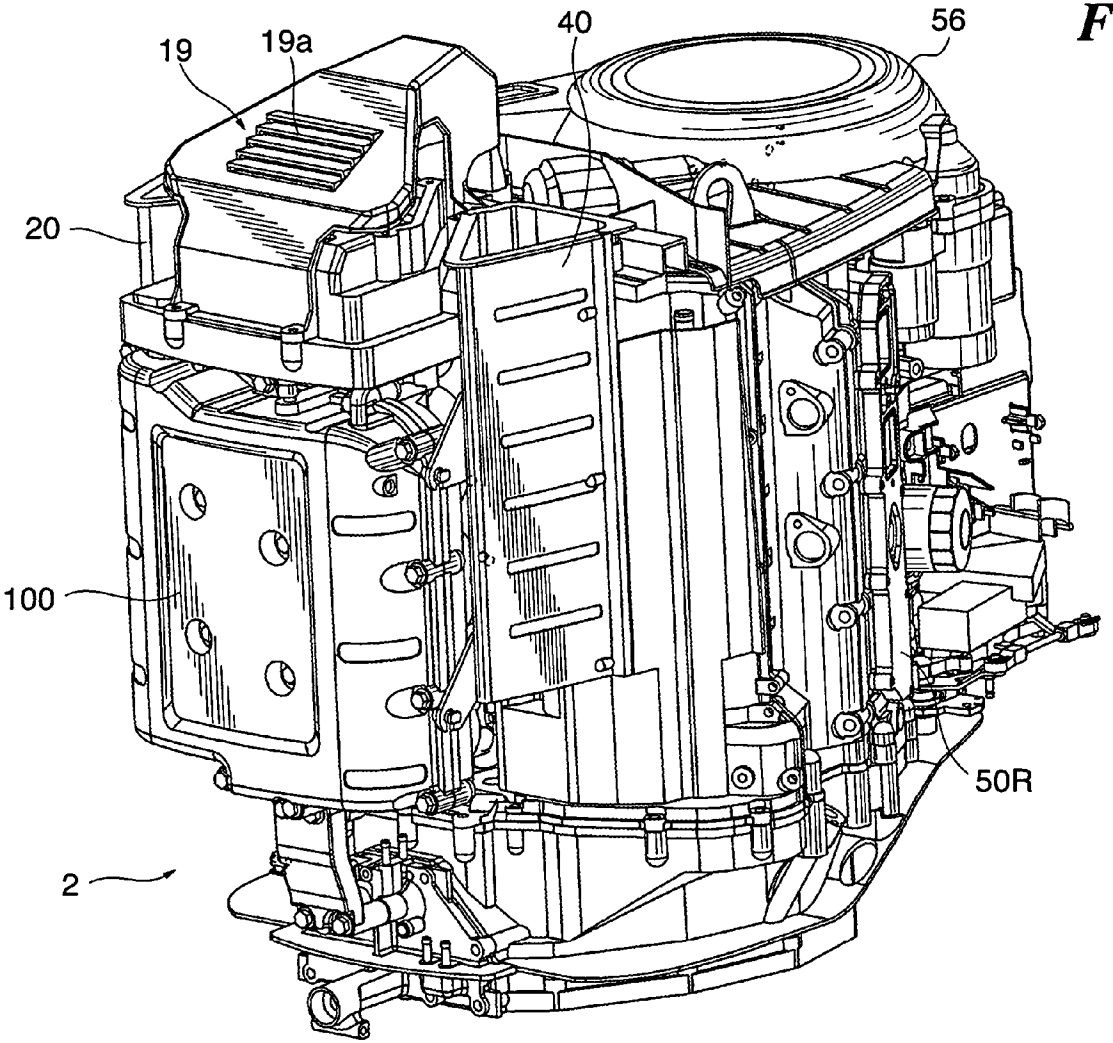
FIG. 18 is a perspective view of the appearance of the engine in FIG. 17, with a silencer mounted thereon.

FIG. 18 is a perspective view showing the appearance of the engine 2 in FIG. 17, with the silencer mounted thereon.

As shown in FIG. 18, in the outboard motor 1, the engine 2 has the silencer 19 mounted on the flywheel magnet cover 56 in a manner covering around the opening 58, i.e. around the throttle body 29. The silencer 19 is formed such that left and right sides thereof are open in the mounted state. Further, in the rear end of an upper face of the silencer 19, there are formed a plurality of openings 19*a* transversely extending parallel and open rearward.

When the assembled engine cover assembly 60 (see FIG. 11) is mounted, from above, on the outboard motor 1 in the state shown in FIGS. 12 and 18, the louver 13 and the air intake guides 14 and 15 in the engine cover assembly 60 are in a position as shown in FIG. 13. In FIG. 13, the top cover 12 and the upper cover 10 are omitted from illustration. The upper opening parts 14*a* and 15*a* of the respective air intake guides 14 and 15 are located in an approximately central part of the engine 2, as viewed in plan view. More specifically, the upper opening parts 14*a* and 15*a* are disposed at respective locations away from any portion of the louver 13 which is formed to extend forward in a bent manner covering the upper opening parts 14*a* and 15*a* along the left and right sides thereof up to respective locations outward of the left and front corners thereof. At the same time, interference between the upper opening parts 14*a* and 15*a* and the magnet device, not shown, is avoided.

In the state where the engine cover assembly 60 is mounted, the upper ends 20*a* and 40*a* (see FIGS. 12 and 16) are generally flush with the forward-of-hole portions 10*ab* and 10*ac* (see FIG. 11) of the upper cover 10. Therefore, the portions of the lower edges 14*c* and 15*c* of the air intake guides 14 and 15 corresponding to the upper ends 20*a* and 40*a* are fitted through the holes 16 and 17 and are brought into contact with the upper ends 20*a* and 40*a* via the sealing members 26 and 46. Thus, there are formed outside air passages communicating via the holes 16 and 17 such that they extend from the upper opening parts 14*a* and 15*a* of the air intake guides 14 and 15 to the lower ends (discharge ports) of the air intake ducts 20 and 40, respectively. The sealing members 26 and 46 prevent leakage of the outside air on their way. The outside air passage is thus formed automatically simply by mounting the engine cover assembly 60 from above, so that trouble in mounting/removal of the engine cover assembly 60 can be eliminated.

In the intake device constructed as above, when the engine 2 is started, outside air is taken into the upper cover 10, first, through the louver 13. The silencer 19 has a front part thereof formed with an opening 19*a* (see FIGS. 12 and 13), but since the opening 19*a* of the silencer 19 is covered from above by a front part 18*a* of the cover part 18 (see FIG. 11), the outside air is prevented from directly flowing into the opening 19*a*.

The outside air having flowed in through the louver 13 enters each of the air intake guides 14 and 15 from an associated one of the upper opening parts 14*a* and 15*a* of the respective air intake guides 14 and 15. When the outside air is on its way to the air intake guides 14 and 15, water contained therein as a mist is easy to drop since the upper opening parts 14*a* and 15*a* are spaced from the louver 13, which enables reduction of the amount of water that enters the air intake guides 14 and 15.

The outside air having flowed into the air intake guides 14 and 15 is introduced into the air intake ducts 20 and 40 from the upper ends 20*a* and 40*a* of the air intake ducts 20 and 40. Then, the outside air is discharged into space under the upper cover 10 from the discharge ports formed in the lower ends of the respective air intake ducts 20 and 40. The lower ends of the respective air intake ducts 20 and 40 are located in the vicinity of the lower end of the engine 2, which makes it difficult for water contained in the outside air to be attached to parts around the engine 2.

The outside air discharged from the lower ends of the respective air intake ducts 2*d* and 40 flows rearward under the upper cover 10, rises in front of the surge tank 100, and then flows into the intake passage member 203 of the throttle body 29 via the opening 58 of the fly wheel magnet cover 56. Thereafter, as described hereinabove, the outside air passes through the surge tank 100, the intake manifold 37, and the intake ports 89 to be supplied to the associated combustion chamber 52 (see FIG. 2). Since the air intake ducts 20 and 40 are disposed in the relatively cool intake device-side space separated by the partition plates 25 and 45, and the space in front of the surge tank 100 is also part of the intake device-side space, the outside air is hardly warmed on its way through the flow path, and hence is supplied to the engine 2, with its coolness maintained.

Since the silencer 19 is mounted to the flywheel magnet cover 56 in a manner covering the throttle body 29 as described above, the vertical protrusion of the silencer in the outboard motor 1 can be reduced, which makes it possible to reduce the size of the intake device.

Further, since the silencer 19 covers around the whole of the electronically-controlled throttle body 29 low in water resistance, it is possible to protect the electronically-controlled throttle body 29 from water, thereby enhancing the durability of the electronically-controlled throttle body 29 in the outboard motor 1.

Furthermore, since the height of the throttle body 29 can be reduced as described above, it is possible to increase the space above the throttle body 29 in the outboard motor 1. Therefore, by forming the silencer 19 such that it covers around the throttle body 29 from above, it is possible to reduce the vertical protrusion of the silencer and increase the capacity of the silencer 19 at the same time.

Moreover, since the throttle body 29 is electronically controlled, and hence it is not required to take the maintainability of the linkage or the operation range of the same into consideration, the arrangement in which the throttle body 29 is entirely covered from above by the silencer 19 does not present any problem. Further, with this arrangement, it is possible to obtain a rust preventive effect for the throttle body 29, which contributes to improvement of the appearance.

As described above, according to the present embodiment, since the size of the surge tank 100 can be reduced, it is possible to dispose the air intake ducts 20 and 40 between the surge tank 100 and the respective cylinder head covers 33L and 33R. This makes it possible to extend the air intake ducts

20 and 40 up to the bottom of the engine 2, i.e. to make them longer. Therefore, the water-separating effect of the air intake ducts 20 and 40 can be improved, which contributes to enhancement of output of the outboard motor 1.

Further, according to the present embodiment, it is possible to increase the inner space of the surge tank 100 and reduce the size of the surge tank 100 at the same time. This makes it possible to reduce the size of the intake device, thereby making the outline or contour of the engine compact in size. In addition, since a sufficient capacity of the surge tank can be secured even in a small space, it is possible to reduce the size of the intake device and improve intake performance at the same time, thereby enhancing the output of the outboard motor 1.

It should be noted that in the present embodiment, a connecting position between each of the wall members 113 and an associated one of the intake passage members 112 is preferably at the outermost of the outer peripheral surface of the associated intake passage member 112. This makes it possible to increase the inner space of the surge tank 100, thereby enhancing the intake efficiency of the intake device.

As described above, according to the present embodiment, since the size of the throttle body 29 can be reduced, it is possible to reduce the size of the intake device. This makes it possible to make the outline of the engine compact in size. In addition, since a sufficient capacity of the silencer can be secured even in a small space, it is possible to reduce the size of the intake device and improve the intake performance at the same time, thereby enhancing the output of the outboard motor 1.

Further, according to the present embodiment, since the silencer 19 covers around the whole of the electronically-controlled throttle body 29 which is low in water resistance, the durability of the throttle body 29 can be enhanced, which makes it possible to improve the durability of the intake device.

Although in the present embodiment, the throttle shaft 202 horizontally extends in the longitudinal direction, and the throttle motor 204 is disposed such that the throttle motor shaft 205 horizontally extends in the longitudinal direction, the manner of arrangement of the throttle shaft 202 and the throttle motor 204 is not limited to this. The throttle shaft 202 and the throttle motor 204 are only required to extend horizontally, for example, and hence the orientation of each of them can be changed independently, as desired, in accordance with associated peripheral components of the engine.

Further, although the throttle body 29 is disposed approximately in the transverse center between the two cylinder banks of the V bank of the engine 2, this is not limitative, but the throttle body 29 may be disposed on the upper face of the surge tank 100 at a location shifted toward one of the left and right banks, for example.

Although in the present embodiment, out of the component parts of the intake device, the air intake ducts 20 and 40 are disposed between the surge tank 100 and the cylinder head covers 33L and 33R, other component parts of the intake device may be disposed in place of the air intake ducts 20 and 40.

Further, although in the present embodiment, the air intake guides 14 and 15 are fixed to the upper cover 10 and the top cover 12, this is not limitative, but there may be formed an upper air intake integral with the upper cover 10 by molding, for example. In this case, by attaching plate-shaped members corresponding to the respective forward-of-hole portions 10*ab* and 10*ac* (see FIG. 11) of the upper surface 10*a* of the upper cover 10 to the lower openings of the respective air intake guides, it is possible to form outside air passages extending from the air intake guides to the air intake ducts 20 and 40 as in the above-described example (see FIG. 11).

Furthermore, although in the present embodiment, the six-cylinder V-type engine is described by way of example, the intake device according to the present invention can also be applied to other V-type engines and other types of engines.

While the present invention has been described with reference to exemplary embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2006-114883, filed Apr. 18, 2006, and Japanese Patent Application No. 2006-125690, filed Apr. 28, 2006 which are hereby incorporated by reference herein in its entirety.

What is claimed is:

1. An intake device for an outboard motor, comprising:

intake ports of a plurality of cylinder bores, respectively, the cylinder bores being formed in cylinder banks which extend rearward in a manner opening to form a V shape and which have the cylinder bores vertically arranged, said intake ports being configured to open in inner sides of the V shape;

an intake manifold configured to be connected to said intake ports;

a surge tank connected to said intake manifold; and a throttle device connected to said surge tank, wherein said surge tank comprises a plurality of intake passage members connected to the cylinder bores, respectively, via said intake manifold, wall members provided between respective adjacent ones of said intake passage members, and a lid member hermetically closing a space defined by said intake passage members and said wall members, and wherein each of said intake passage members is coaxial with an associated one of said intake ports.

2. An intake device as claimed in claim 1, wherein said throttle device is configured to be mounted on one of said wall members disposed on an upper surface of said surge tank.

3. An intake device as claimed in claim 2, wherein said throttle device comprises an electronically-controlled throttle valve.

4. An intake device as claimed in claim 2, wherein said throttle device is disposed at a location such that an upper end face thereof does not protrude higher than a rotary member mounted on an upper end of a crankshaft of said outboard motor.

5. An intake device as claimed in claim 2, wherein said throttle device includes an intake passage member extending in the vertical direction.

6. An intake device as claimed in claim 2, further comprising a silencer covering around said throttle device.

7. An intake device as claimed in claim 1, further comprising air intake ducts arranged in a space enclosed by the cylinder banks, said surge tank, and an engine cover.

* * * * *